US006497287B1

(12) United States Patent
Podio et al.

(10) Patent No.: US 6,497,287 B1
(45) Date of Patent: Dec. 24, 2002

(54) PRODUCTION SYSTEM AND METHOD FOR PRODUCING FLUIDS FROM A WELL

(75) Inventors: Augusto L. Podio, Austin, TX (US); Paulo M. Carvalho, Rio de Janeiro (BR); Kamy Sepehrnoori, Austin, TX (US)

(73) Assignee: The Board of Regents, The University of Texas System, Austin, TX (US)

( * ) Notice: Subject to any disclaimer, the term of this patent is extended or adjusted under 35 U.S.C. 154(b) by 0 days.

(21) Appl. No.: 09/589,608

(22) Filed: Jun. 7, 2000

Related U.S. Application Data

(60) Provisional application No. 60/137,846, filed on Jun. 7, 1999.

(51) Int. Cl.[7] ..... E21B 43/12

(52) U.S. Cl. ..... 166/370; 166/105

(58) Field of Search ..... 166/105, 105.5, 166/106, 265, 369, 370, 305.1, 313

(56) References Cited

U.S. PATENT DOCUMENTS

| | | | |
|---|---|---|---|
| 4,294,573 | A | 10/1981 | Erickson et al. |
| 4,381,175 | A | 4/1983 | Erickson |
| 4,625,798 | A | 12/1986 | Bahy, III |
| 4,828,036 | A | 5/1989 | Simmons |
| 5,015,370 | A | 5/1991 | Fricano |
| 5,147,530 | A | 9/1992 | Chandler et al. |
| 6,089,317 | A | 7/2000 | Shaw |
| 6,168,388 | B1 | 2/2001 | Hughes et al. |

FOREIGN PATENT DOCUMENTS

| | | |
|---|---|---|
| WO | 98/34009 | 8/1998 |

OTHER PUBLICATIONS

Lea et al., "Effect of Gaseous Fluids on Submersible Pump Performance," Journal of Petroleum Technology, Dec. 1982, pp. 2292–2929.

Sachdeva et al., "Performance of Electric Submersible Pumps in Gassy Wells," Society of Petroleum Engineers, Oct. 1991, pp. 81–94.

Turpin et al., "Gas Liquid Flow Through Centrifugal Pumps—Correlation of Data," Proceedings of the Third International Pump Sumposium, 1986, pp. 13–20.

Beggs et al., "A Study of Two–Phase Flow in Inclined Pipes," Journal of Petroleum Technology, May 1973, pp. 607–617.

Hagedorn et al., "Experimental Study of Pressure Gradients Occuring During Continuous Two–Phase Flow in Small-Diameter Vertical Conduits," Journal of Petroleum Technology, Apr. 1965, pp. 475–484.

(List continued on next page.)

*Primary Examiner*—Frank S. Tsay
(74) *Attorney, Agent, or Firm*—Howrey Simon Arnold & White, LLP

(57) ABSTRACT

A production system and method for producing fluids from a well are presented. The production system may include a submersible pump and a jet pump. The submersible pump may be arranged within the well. The jet pump may be arranged within the well downstream of the submersible pump. The jet pump may include a power fluid intake configured to receive a power fluid and a produced fluid intake configured to receive a produced fluid. The power fluid intake may be in fluid communication with the submersible pump. The produced fluid intake may be in fluid communication with gas within the well. In an embodiment, the produced fluid intake may be in fluid communication with separated gas within an annulus of the well. Beneficially, the system may allow, among other things, a submersible pump and a jet pump to be used in combination in high gas-liquid-ratio wells without installing a gas vent line.

27 Claims, 14 Drawing Sheets

OTHER PUBLICATIONS

Carvalho et al., "Modeling a Jet Pump with an Electrical Submersible Pump for Production of Gassy Petroleum Wells," Society of Petroleum Engineers, Sep. 1998, pp. 53–65.

Boatright, "Basic Petroleum Engineering Practices," Jul. 1995, pp. 1–38.

Carvalho et al., "Modeling a Jet Pump in Combination with Electrical Submersible Pump Producing High Gas–Liquid–Ratio Petroleum Wells," Jun. 1998, pp. 1–8.

"An Electrical Submersible Jet Pump for Glassy Oil Wells," JPT, vol. 51, No. 5, May 1999, pp. 34–35.

International Search Report, Application No. PCT/US 00/15708, mailed Sep. 19, 2000.

PRODUCTION SYSTEM AND METHOD FOR PRODUCING FLUIDS FROM A WELL

PRIORITY CLAIM

This application claims the benefit of U.S. Provisional Application No. 60/137,846 entitled "DOWNHOLE PRODUCTION ASSEMBLY INCLUDING A SUBMERSIBLE PUMP AND A JET PUMP" filed Jun. 7, 1999, the disclosure of which is incorporated herein by reference.

BACKGROUND OF THE INVENTION

1. Field of the Invention

The present invention relates to pumping equipment. More particularly, the invention relates to, in one embodiment, a production system for producing fluids from a well that includes a jet pump and a submersible pump.

2. Description of the Related Art

The information described below is not admitted to be prior art by virtue of its inclusion in this Background section.

As the technology for offshore deep-water exploitation becomes available at a reasonable cost, the number of sub-sea completions in deep and ultra-deep waters is expected to increase significantly. Evidence of this expected increase in deep-water production may be seen in the large number of tracts in water deeper than 5000 feet that were leased in the recently completed Gulf of Mexico Outer Continental Shelf (OCS) lease sales. FIG. 1 presents the evolution of the tracts receiving bids in the recent lease sales and clearly emphasizes the expectations of the oil companies. (The asterisk in FIG. 1 denotes years in which a royalty relief program was in effect.) FIG. 2 presents a bar graph that shows the increasing production (expressed in % increase by year) from the deep and ultra-deep waters in the Gulf of Mexico. Other important evidence of increased deep-water production may be seen in the increasing activity of Petrobras. The Brazilian Petroleum Company started the exploitation of the Campos Basin offshore Rio de Janeiro, Brazil, in 1979 at water depths of 300 feet, and since then has worked continuously towards deeper waters where some important discoveries have been made. Today, high productivity wells have been producing steadily and successfully at water depths greater than 5000 feet in the Marlin and Albacore fields.

Production platforms are typically installed when producing from offshore wells. While the installation of a production platform in deep water is sometimes technically feasible, such an installation is more complicated, and thus more expensive, than installing a production platform in shallower water.

Consequently, the host production platforms in offshore petroleum production projects are usually installed in shallow water, which often requires a long flowline between the platform and the deep wells. With the wells located far from the host platform, the wellhead flowing pressures generally have to be maintained at a level sufficient to overcome high frictional losses plus the hydraulic head for the produced fluids to be able to flow back to the platform. The high wellhead pressure required to flow production back to the host platform will in turn tend to limit a pressure differential (or drawdown) that may be established at the reservoir. As a result, the production rates of the deep wells may be reduced to uneconomic levels.

A possible solution to the problem created by the installation of the host platform far from the production wells is the application of existing artificial-lift (AL) methods. AL methods supply the fluids produced from the well with sufficient energy to generate adequate drawdown at the formation while maintaining a high enough wellhead pressure to transport the fluids to the host platform at a desired flow rate. The AL method most commonly used for sub-sea offshore petroleum production is the gas lift (GL). A purpose of the GL method is to inject gas into the tubing string downhole in order to reduce the hydraulic head without increasing the friction losses so that the net result is an increase in the wellhead pressure for a fixed bottomhole pressure.

While the increase in the gas-liquid ratio (GLR) obtained with the GL method is highly beneficial for vertical multiphase flow, such an increase is not as helpful for horizontal flow. For long-distance horizontal multiphase flow, the net result of the increase in the GLR may be detrimental since the friction loss increases and there is little or no reduction in the hydraulic head. In addition, the increased GLR will create an operational problem with long-distance horizontal flow due to the instability of the slug flow that is expected to occur. Another problem with the GL method is that it requires an annulus lift-gas line, which for long distances will significantly increase the final cost of the project.

Pumping AL methods are also available for sub-sea applications. Such methods include the electrical submersible pump (ESP), the Progressing Cavity Pump (PCP), and the Jet Pump (JP). Present technology applies ESP's for pumping of liquid with small amounts of free gas (up to about 5% or so) while JP's are used to pump liquids using a liquid power fluid. An ESP typically includes a multistage centrifugal pump driven by a coupled electric motor. The pump may be installed inside the well at the end of the tubing string, and is typically situated at a certain depth below the fluid level. An electric cable connecting the surface transformer to the electric motor feeds electric power.

The JP is an AL method with no moving parts. The JP, which primarily consists of a body with a nozzle, a throat, and a diffuser, is set in a nipple inside the tubing string. Substantially clean power fluid is pumped down from the surface to the pump through the tubing. This power fluid passes through the nozzle, creating a low-pressure region connected to the pump intake so that the well fluid is suctioned into the throat region of the JP. The mixed fluid, i.e., power fluid plus produced fluids, exits the pump through the diffuser into the casing with sufficient head to overcome the hydraulic head plus the head losses.

To date, the majority of the pumping AL systems are being operated at conditions where there is a minimum of free gas present at the pump intake. As may be learned from Ref. 1 to Ref. 6, that free gas is, in many instances, detrimental to proper operation of these pumps. Consequently, it is not recommended to apply these systems without some provision for separation of the gas before reaching the pump intake. A requirement for the application of AL methods to sub-sea petroleum production is the necessity to operate relatively efficiently with a multiphase gas-liquid mixture because it is not desired, for economic reasons, to have an extra produced-gas flowline for each well. Without the annulus flowline, it is generally not possible to utilize the annular space as a downhole separator and to vent the gas at the casinghead.

The application of an ESP to a well having a high free-gas volume at the pump intake usually requires the installation of a gas separator. The use of a gas separator, however, may require the costly installation of an extra flow line to vent the separated gas to the host platform. Therefore, it would be desirable, in some embodiments, to design a production system that would allow an ESP to be used in a high free-gas well without requiring the installation of a vent line.

SUMMARY

A production system may include a submersible pump and a jet pump. The submersible pump may be arranged within the well. The jet pump may be arranged within the well downstream of the submersible pump. The jet pump may include a power fluid intake configured to receive a power fluid and a produced fluid intake configured to receive a produced fluid. The power fluid intake may be in fluid communication with the submersible pump. The produced fluid intake may be in fluid communication with gas within the well. In an embodiment, the produced fluid intake may be in fluid communication with separated gas within an annulus of the well. The system may allow, among other things, a submersible pump (possibly an ESP) to be used in high GLR wells without installing a gas vent line.

In an embodiment, the jet pump may be positioned at the discharge of the submersible pump, and may use the fluid pumped by the submersible pump as a power fluid. In addition, a gas separator may be positioned upstream of the submersible pump. The gas separator may be configured to separate gas from liquid to produce separated gas and separated liquid. The separated liquid may be drawn into the submersible pump, while the separated gas may be segregated downstream within the annulus. The jet pump may then draw in the separated gas through the produced fluid intake, and later compress the gas and entrain the gas back into the separated fluid stream to be pumped to the surface. The use of a gas separator may reduce the amount of free gas that the submersible pump ingests and, as a consequence, may increase the performance of the submersible pump. Such a production system may be especially useful for wells with high GLR.

The system may allow a submersible pump and a jet pump to be combined into a single integrated system having the objective of economically producing a well without reducing the efficiency of the submersible pump or increasing the cost of the installation. The application of the system may increase the number of satellite wells that are able to use artificial lift to increase or maintain oil and gas flow rates, since high GLR wells may be produced using the system. Application of the production system may increase the profitability of future exploitation projects because it may be possible to increase the distance between the host platforms and the wells, which may result in a reduction of the number of host platforms needed. This new technology may be applied to any petroleum production well, but may have particular use in deep-water offshore exploitation.

Therefore, certain embodiments of the present production system may have one or more advantages. The system may provide an efficient artificial lift method for offshore and land (i.e., onshore) wells where the gas to oil ratio has increased past the operating limits of ESPs. Further, the system may provide an artificial lift method for deep offshore sub-sea wells without the need for a separate sub-sea gas vent line. The system may reduce power requirements for conventional ESP installations by reducing the required discharge pressure. The system may increase production rate by reducing the flowing bottom hole pressure in ESP wells. In addition, all elements of the downhole production system may be installed at once or at different times in the life of the well or wells being produced.

In many conventional ESP installations on integrated offshore platforms and onshore installations, gas from a reservoir is permitted to escape from the bottomhole fluids prior to its entering the submersible pump. This gas may be produced up the annulus as casinghead gas, and may be removed separately from the well at the casinghead, from which it may be directed into a separate pipeline from the produced fluids or vented. Because of the expense of a separate flow line and the environmental and/or safety concerns of venting, it may be beneficial to provide a way to produce these gases.

In an embodiment, the present production system may be used to produce such a well. That is, the production system may further include a casinghead valve configured to selectively permit gas within the annulus to pass into a conduit outside of the well. The conduit may be connected to a pipeline to be transported to a production facility, or to a vent. The casinghead valve may initially be open to permit casinghead gas to pass into the conduit. Subsequently, the casinghead valve may be closed to substantially prevent gas within an annulus of the well from escaping. Pressure within the annulus may be allowed to increase to a pre-determined pressure before initiating pumping of well fluids with the submersible pump. Once normal operation of the submersible pump and jet pump begins, the casinghead gas may be suctioned into the produced fluid intake of the jet pump, compressed, and entrained with the produced fluids pumped into the power fluid intake of the jet pump from the submersible pump.

Furthermore, an embodiment of a production system may be a packerless (i.e., open annulus) completion. That is, the annulus of the well defined between the production tubing string and the casing string may be devoid of isolation packers. It may be beneficial, however, to use isolation packers with wells, and thus the present production system may be used with such devices. Therefore, an embodiment of the production system includes an isolation packer positioned within an annulus of the well. The isolation packer may be positioned downstream of the jet pump and between a tubing string and a casing string within the well. The isolation packer may be used to trap well fluids and gases downhole of the packer. This configuration may reduce the pressure in the annulus gas with a corresponding decrease in flowing bottomhole pressure. Such a design may allow for the production of the well at higher rates if the pressure within the annulus upstream (e.g., downhole) of the packer is maintained above bubble point pressure.

In addition, an embodiment of a production system may combine a production system including a jet pump and a submersible pump with gas lift injection techniques. As noted above, gas lift is an artificial lift method in which gas is injected into the production tubing to reduce the fluid gradient of the fluids being produced. Gas lift processes may reduce the flowing bottomhole pressure, and thus the submersible pump discharge pressure and power requirements.

In an embodiment, the production system may include a gas lift injection system configured to inject gas within the well. The gas lift injection system may be further configured to inject gas into an annulus of the well. In such a configuration, the jet pump may be used as a substitute for the operating gas lift valve of a conventional gas lift injection assembly. Thus, gas injected into an annulus from the gas lift injection system may enter a tubing string within the well through the produced fluid intake of the jet pump to supply gas lift forces on fluids within the tubing, thereby reducing the flowing bottomhole pressure.

An embodiment of the production system may include at least one, and possibly a plurality of, gas lift valve(s)

arranged downstream of the jet pump. The gas lift valves may further be arranged along the tubing string uphole of the jet pump. The gas lift valves may each be configured to selectively permit gas injected into the annulus to pass therethrough and, in an embodiment, to pass through the gas lift valves into the tubing string. That is, the gas lift valves may be configured to open and close to permit and prevent, respectively, fluids from passing therethrough under certain pre-determined conditions.

In another embodiment, the gas lift valves may be unloading gas lift valves. Thus, the gas lift valves may be used to unload liquid from the well to allow gas to be injected into the produced fluid intake of the jet pump. In such an unloading process, the fluid level may be above at least one, and possibly all, of the gas lift valves within the well. Gas may then be injected into the annulus of the well to depress the fluid level therein. As the fluid level within the well drops below each gas lift valve, the gas lift valves may each selectively permit gas injected into the annulus to enter the tubing, further aiding in the depression of the well fluid level. After injected gas has been selectively permitted to pass through each of the gas lift valves, the fluid level within the well may be lowered below the jet pump. The gas lift valves may remain closed when the fluid level within the well is below the jet pump (e.g., during normal operation of the production system), allowing substantially most or all of the injected gas to enter the tubing string through the jet pump.

Advantageously, gas injection into a jet pump as presented herein may allow for lower gas lift injection pressures or injection of gas at higher rates. In either case, the efficiency of such a system may be significantly improved over conventional gas lift installations.

BRIEF DESCRIPTION OF THE DRAWINGS

Other objects and advantages of the invention will become apparent upon reading the following detailed description and upon reference to the accompanying drawings in which.

Figure 1:
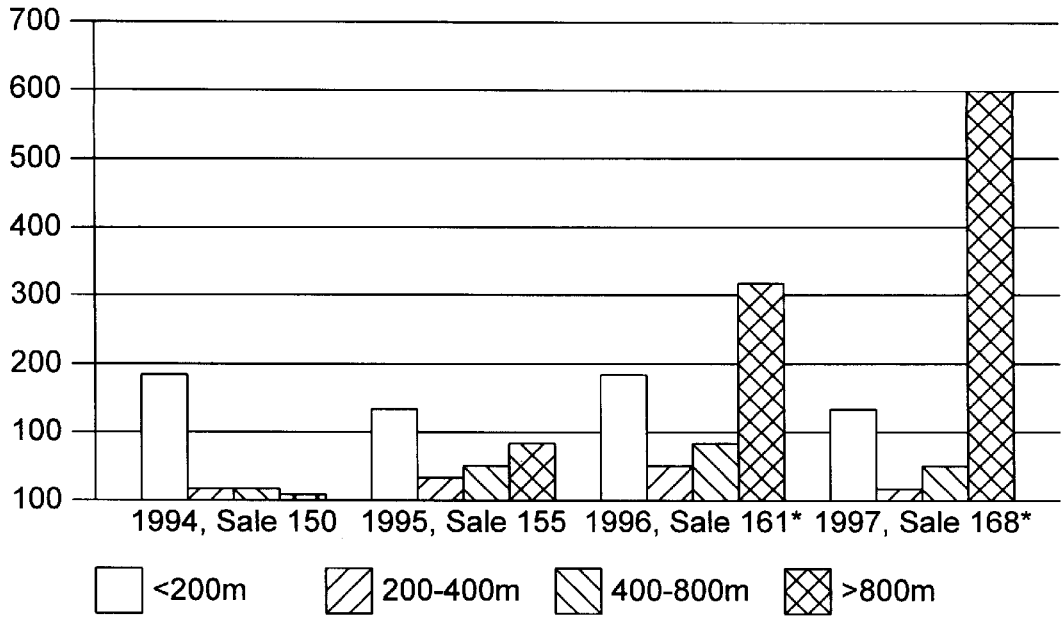
FIG. 1 is a bar graph showing the evolution of tracts receiving bids in recent Gulf of Mexico OCS lease sales.
Figure 2:
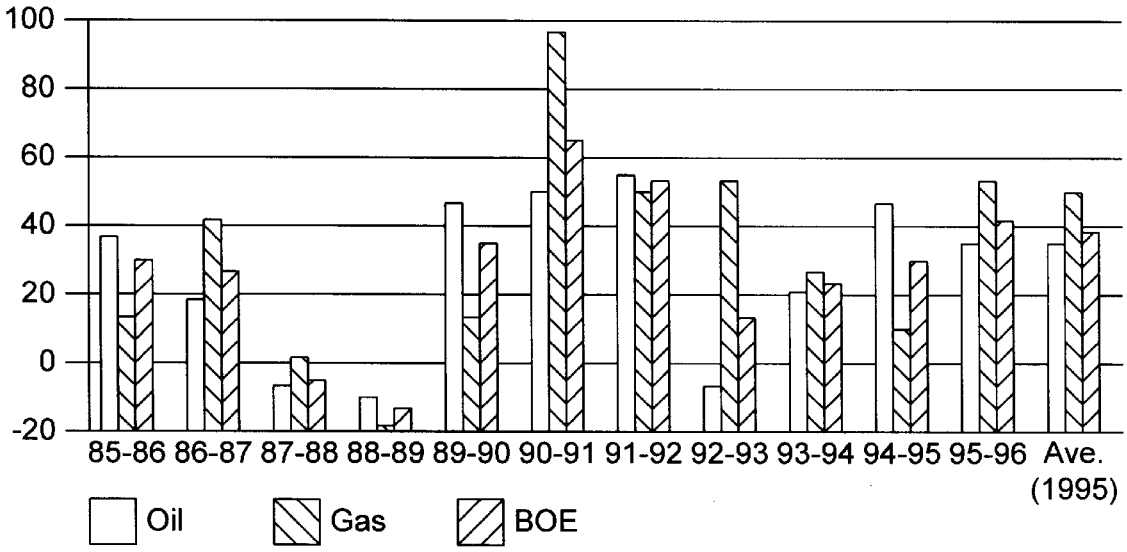
FIG. 2 is a bar graph showing the percentage increase in production from Gulf of Mexico deep and ultra-deep waters in recent years.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF PREFERRED EMBODIMENTS

Figure 3:
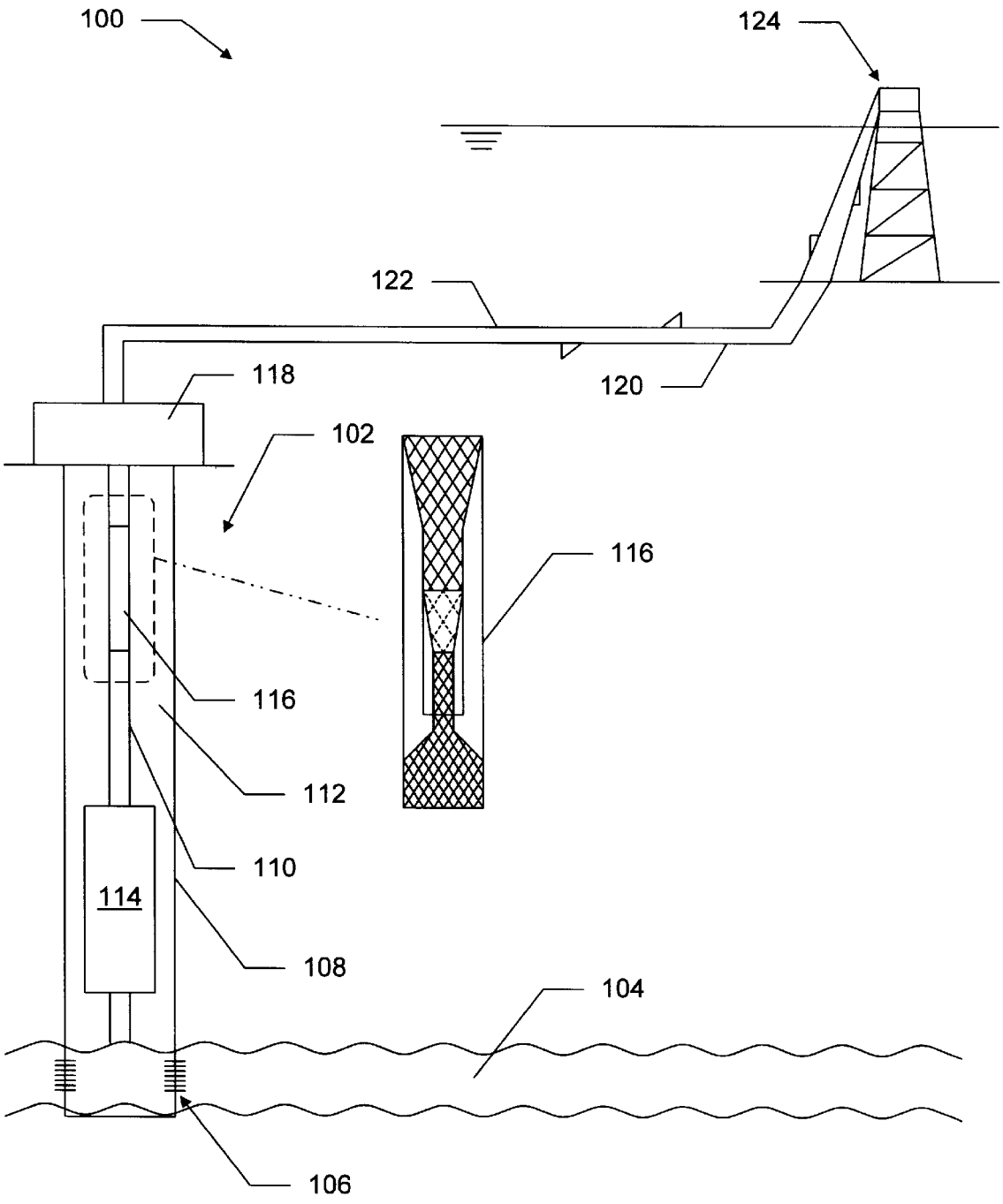
FIG. 3 is a schematic diagram of a deep-water hydrocarbon production system.

FIG. 3 is a schematic view of a deep-water hydrocarbon production system that includes an embodiment of a production system as described herein. Production system 100 may include a well 102 extending to an underground reservoir 104. Perforations 106 may be present in the reservoir to aid in production of the well. A casing string 108 may extend to or above reservoir depth. Casing string 108 may include multiple casing strings of progressively smaller diameters. A tubing string 110 may be arranged within the casing string. An annulus 112 may be defined between casing string 108 and tubing string 110. Tubing string 110 may extend, in an embodiment, to a depth above the bottom depth of casing string 108. An artificial lift sub-assembly 114 may also be installed within the well, and in an embodiment may be installed below the fluid level within the well (not shown). A jet pump 116 may be located downstream (e.g., uphole) of artificial lift sub-assembly 114. (As referred to herein, "downstream" and "upstream" may refer to the direction of flow from and towards, respectively, a reservoir. In predominantly vertically oriented wells such as well 102, downstream may correspond to "uphole.") A wellhead 118 may be arranged on top of well 102 and above the sea floor. Production facilities 124 may be located away from the well in shallower waters than the well. A pipeline 120 may extend between wellhead 118 and production facilities 124. An electrical cable 122 may also run between wellhead 118 and production facilities 124.

Artificial lift sub-assembly 114 may include a submersible pump and, optionally, a gas separator. If present, the gas separator may be a rotary gas separator (RGS). The gas separator may be located immediately upstream of the submersible pump and, in an embodiment, may be located at the intake of the submersible pump. As stated above, artificial lift sub-assembly 114 may be located below the fluid level within well 102. The well fluids at the bottom of well 102 and within reservoir 104 ("bottomhole fluids") may include liquids (both liquid hydrocarbons and water) and free gas. The gas separator may be configured to separate out a substantial portion, and possibly a majority, of the free gas within the bottomhole fluids. The free gas may be segregated up annulus 112. It should be understood, however, that a gas separator is not required. Free gas may separate from the bottomhole fluids naturally with or without the use of a gas separator. Such natural separation and segregation of free gas up the annulus may, by itself, sufficiently reduce the GLR of the fluids entering the submersible pump. In either case, the free gas separated from the bottomhole fluids (whether by mechanical or natural means) may be considered separated gas, and the well production minus the free gas separated out (by, e.g., the gas separator and/or natural processes) may be considered separated fluid. The separated fluid may include liquid hydrocarbons, possibly derived from an oil-bearing reservoir adjacent the well (e.g., reservoir 104), and water. The separated fluid may also have particles (e.g., sediment) entrained therein. The separated gas may include gaseous hydrocarbons.

The separated fluids may be drawn into an intake of the submersible pump downstream. If a gas separator is present in the well, the separated fluids may be substantially gas-free. The separated fluids pumped by the submersible pump, however, may contain substantial quantities of dissolved gases. As with most centrifugal pumps, the performance of the electrical submersible pump may be deleteriously affected by the presence of free gas. By reducing the amount of free gas within the fluids ingested by the submersible pump, a gas separator may help to avoid a reduction of pump performance caused by the high GLR of gassy wells, and may increase the performance of the submersible pump.

The submersible pump may be an electrical submersible pump (ESP). The ESP may be a multistage centrifugal pump specifically designed to be installed inside the casing in petroleum wells below the liquid level. The ESP may be coupled to electrical cable 122 for receiving electrical power from, e.g., production facilities 124. This electrical power may be used to drive a coupled electrical motor. The submersible pump may expel the separated fluids through an outlet port. The submersible pump is not required to be an ESP, but may instead be configured as other pump types, such as hydraulic submersible pumps.

As stated above, jet pump 116 may be located downstream (e.g., uphole) of the artificial lift sub-assembly, including the submersible pump. Jet pump 116 may be configured to allow the gases separated out by the gas separator and segregated up annulus 112 to be re-injected back into the separated fluids pumped by the submersible pump. Jet pump 116 may be arranged relatively deeply within well 102 to maximize the reduction in tubing flowing gradient provided during operation. The enlarged projection of jet pump 116 in FIG. 3 illustrates the features of jet pump 116 in more detail; further discussion of specific elements of jet pump 116 will be provided below.

The production system shown in FIG. 3 may be a packerless (i.e., open annulus) completion. That is, the well may not contain any sealing or isolation packers isolating one zone of the well from other zones. As will be shown below, a packer may, however, be used in an embodiment.

Figure 5:
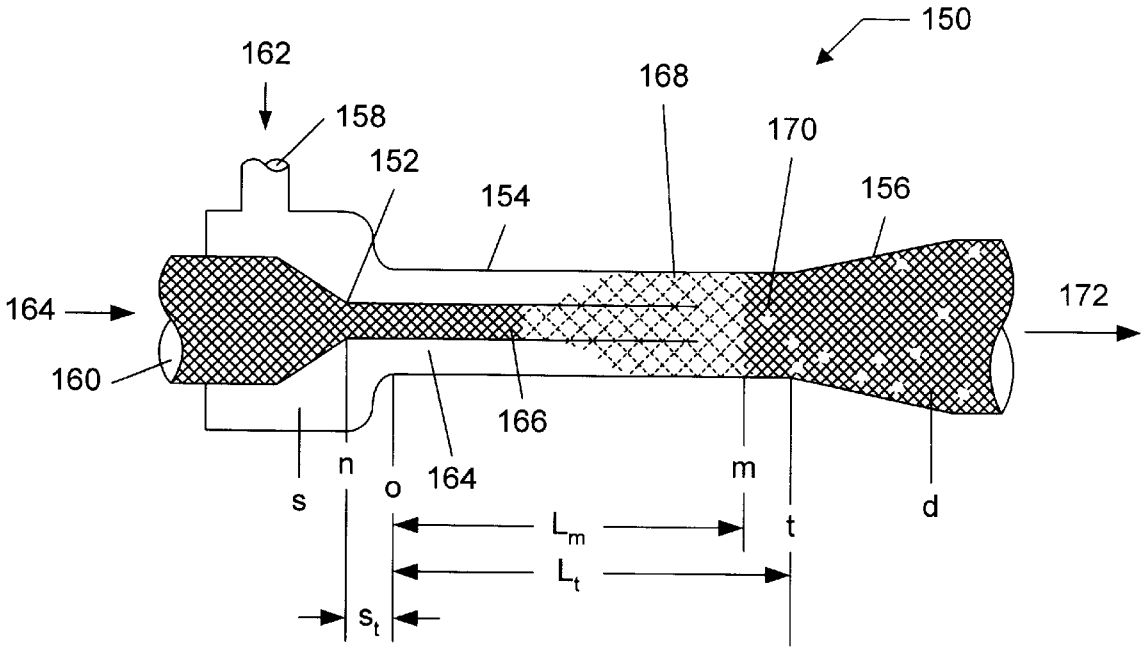
FIG. 5 is a sketch of a liquid jet gas pump in accordance with an embodiment.

An embodiment of jet pump 116 is shown in more detail in FIG. 5. The jet pump may be a liquid-jet gas pump (LJGP). Jet pump 116 may have no moving parts. Jet pump 116 may include a jet pump body 150 with a nozzle 152, a throat 154, and a diffuser 156. Jet pump 116 may be set in a nipple inside tubing string 110. Jet pump 116 may include a produced fluid intake 158 configured to receive a produced fluid 162 and a power fluid intake 160 configured to receive a power fluid 164.

Power fluid 164 may be the same liquid pumped by the submersible pump (e.g., the separated fluids). Consequently, power fluid intake 160 may be in fluid communication with the submersible pump. In an embodiment, power fluid intake 160 is in fluid communication with a submersible pump outlet port through tubing 110. Produced fluid intake 158 may be in fluid communication with produced gases 162 within well 102 and, in an embodiment, within annulus 112 of the well. The produced fluids may be the separated gas, e.g., the free gas separated out of the well fluids, possibly by a gas separator, and segregated up annulus 112. If a gas separator is included as part of artificial lift sub-assembly 114, produced fluid intake 158 may be in fluid communication with the gas separator. More specifically, produced fluid intake 158 may be in fluid communication with an outlet port of the gas separator through annulus 112. As set forth herein, however, the phrase "in fluid communication" should not be construed to require that there is a direct connection between the elements stated to be "in fluid communication," nor should it be construed to prohibit other elements from intervening therebetween; rather, two elements between which fluid can flow (i.e., communicate) may be deemed "in fluid communication" regardless of the mechanism of connection.

In FIG. 5, lowercase subscripts denote primary points of interest. The "i" may indicate the inlet region of jet pump 116, which may be the region inside the pipe prior to nozzle 152. The "s" may indicate the pump suction region, which may be the region where the gas stream enters the device. The "n" may indicate the nozzle region. The "o" and "t" may indicate the beginning and the end of the throat region, respectively. The "m" may indicate the point in the throat (mixing zone 168) where the mixture between the two entering phases is completed, e.g., the point where the very first homogeneous mixture (bubbly mixture 170) appears. Finally, the letter "d" may indicate the diffuser region. From now on, in the nomenclature, a two-digit index will be adopted whenever useful. The first digit is a number and refers to the fluid, 1 to the liquid (e.g., the separated fluids), which will be considered incompressible, and 2 to the gas (e.g., the separated gas), which will be assumed ideal. The second letter indicates the point in the diagram as cited before. For example, $V_{10}$ indicates the liquid (index 1) velocity at the throat entrance (index o).

The liquid (e.g., separated fluids) may enter jet pump 116 through power fluid intake 160. From there, the liquid may pass into nozzle 152. The liquid may leave nozzle 152 as a liquid jet 166 and enter the throat region at point o. As the liquid passes through the nozzle, a low pressure region may be created. The low-pressure region may be connected to produced fluid intake 158, which may in turn be connected to annulus 112 into which the separated gas (again, possibly the gas that has been separated by the gas separator from the well fluids prior to entering the submersible pump) has been segregated. Because of the reduced pressure around produced fluid intake 158, the gas may be suctioned into the throat region of the jet pump.

Under normal operational conditions, liquid jet 166 may enter the throat region at a velocity $V_{1o}$ surrounded by a gas annulus 164 entering at $V_{2o}$. Such behavior has been observed in the experiments of Betzler[10] and Higgins[11] using a Plexiglas model of a liquid jet gas pump.

In an embodiment, there may be a distinct boundary between liquid jet 166 and gas annulus 164 at the beginning of the throat region. After a certain point, the phases may start to mix intimately in throat 154 and, if the throat is long enough, there may be a mixed fluid stream 172 exiting from jet pump 116 as a homogeneous bubbly mixture 170. The homogeneous mixture of gas bubbles in liquid may be decelerated in the diffuser region. In the throat's mixing process, the transfer of momentum from the liquid may serve largely to compress the gas, in contrast with a liquid-liquid (LL) jet pump in which significant momentum transfer is involved in increasing the kinetic energy of the secondary liquid stream. The pressure recovery in diffuser 156 may be significantly reduced because the liquid may perform most of the work in compressing the entrained gas bubbles. The mixing process, in which the disintegrating liquid jet 166 may entrain, accelerate and compress the gas, may occur at a location in the throat region controllable by the discharge pressure, for a given nozzle rate $Q_1$ and a suction pressure $P_s$. A high $P_d$ value may force early mixing; a lower pressure may move the mixing zone downstream.

Mixed fluid 172, e.g., power plus produced fluids, shown exiting diffuser 156 in FIG. 5 may be the original well fluid since it is, in reality, the well liquid that has been pumped by the submersible pump, plus the well gas that has been pumped by the jet pump. The total well production (e.g., all the mixed fluid) may exit jet pump 116 through diffuser 152 into tubing string 110 with sufficient head to overcome the hydraulic head plus the head losses. The mixed fluid may travel into wellhead 118 and subsequently into pipeline 120 to be transported to production facilities 124.

As noted above, in many conventional ESP installations on integrated offshore platforms and onshore installations, gas from a reservoir is permitted to escape from the bottomhole fluids prior to its entering the submersible pump. This gas may be produced up the annulus as casinghead gas, and may be removed separately from the well at the casinghead, from which it may be directed into a separate pipeline from the produced fluids or vented. Because of the expense of a separate flow line and the environmental and/or safety concerns of venting, it may be beneficial to provide a way to produce these gases.

Figure 17:
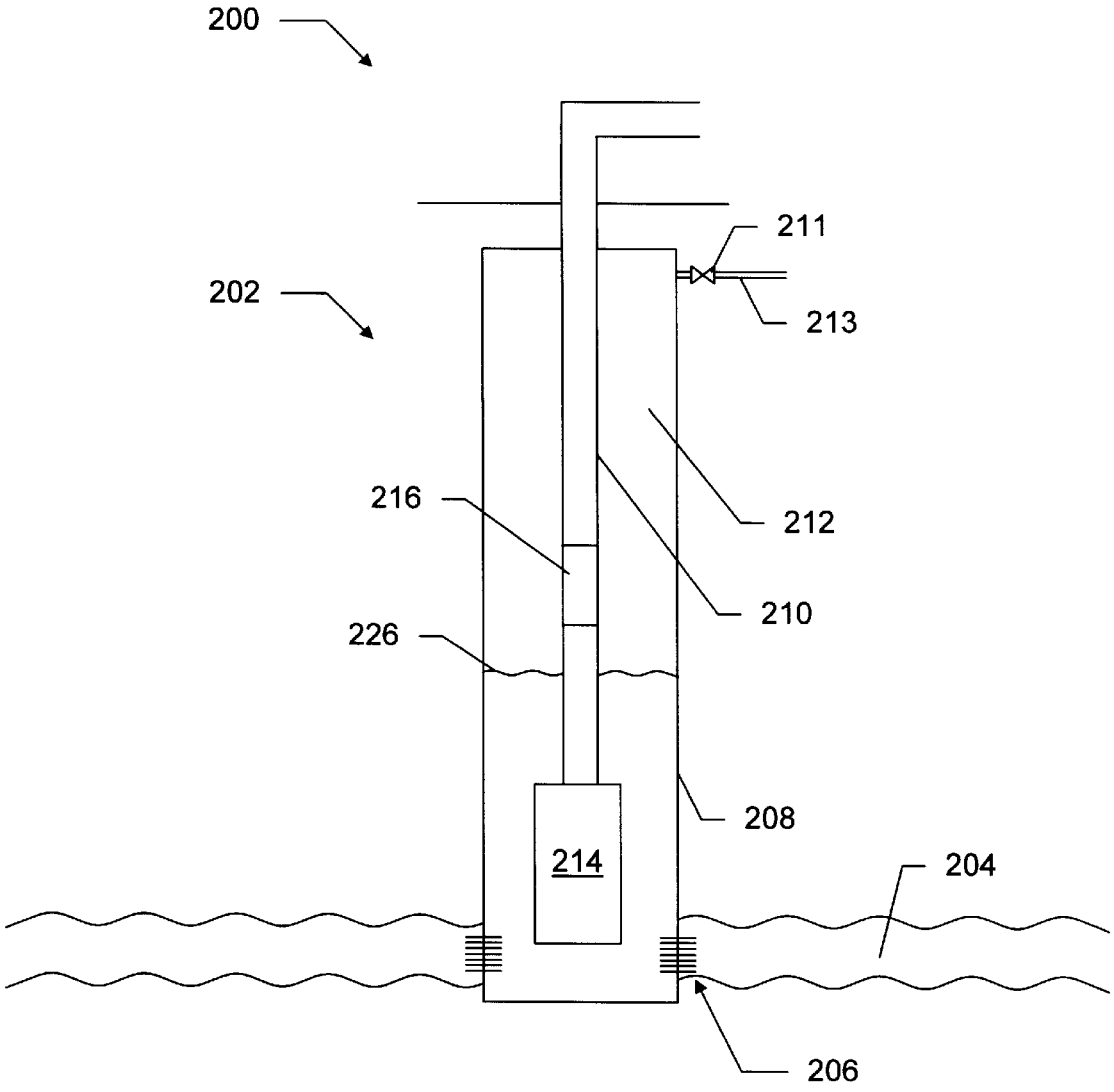
FIG. 17 is a schematic diagram of a production system for producing fluids from a well in accordance with another embodiment.

FIG. 17 depicts a schematic view of a production system 200 that may be used to produce such a well in accordance with another embodiment. Production system 200 may include a well 202 extending to an underground reservoir 204. Perforations 206 may be present in the reservoir to aid in production of the well. A casing string 208 may extend to or above reservoir depth. Casing string 208 may include multiple casing strings of progressively smaller diameters. A tubing string 210 may be arranged within the casing string. An annulus 212 may be defined between casing string 208 and tubing string 210. Tubing string 210 may extend, in an embodiment, to a depth above the bottom depth of casing string 208. An artificial lift sub-assembly 214 may also be installed within the well, and in an embodiment may be installed below the fluid level 226 within the well. The artificial lift sub-assembly may include a gas separator upstream of the submersible pump as described above. A jet pump 216 may be located downstream of artificial lift sub-assembly 214. Components shown in FIG. 17 having similar reference numbers as components shown in FIG. 3 may constructed similarly and may perform in a similar manner as their counterpart components from FIG. 3 (e.g., jet pump 216 may perform similarly to jet pump 116, and tubing 210 may be composed of the same materials as tubing 110). In addition, system 200 may include components of FIG. 3 that are not shown in FIG. 17, such as a wellhead. Appropriate modifications may be made, however, to the design and/or function of each element in accordance with the particular conditions of each embodiment. Production system 200 may be implemented in offshore or onshore wells.

As shown in FIG. 17, production system 200 may also include casinghead valve 211 connected to conduit 213. Casinghead valve 211 may be configured to direct free gas (e.g., separated gas) within the annulus to a separate flow line or to a vent. More specifically, casinghead valve 211 may be configured to selectively permit gas within annulus 212 to pass into conduit 213 outside of well 202. Conduit 213 may be in fluid communication with a pipeline to be transported to a production facility (e.g., production facilities 124) or to a vent. Casinghead valve 211 may initially be open to permit casinghead gas to pass from annulus 212 into conduit 213. Subsequently, casinghead valve 211 may be closed to substantially prevent gas within annulus 212 of well 202 from escaping. Thus, the casinghead gas (e.g., separated gas) may be trapped within the well. Since closure of casinghead valve 211 may limit the means by which the casinghead gas may escape, the gas may accumulate within annulus 212. During this time, the pressure within the annulus may increase as a result of gas accumulation. The time between closure of casinghead valve 211 and initiation of operation of the submersible pump of artificial lift sub-assembly 214 may be designed to allow pressure within annulus 212 to rise to a pre-determined level.

System 200 may then be operated in a manner similar to that described for system 100. During operation, casinghead gas within annulus 212 may serve as a produced gas for jet pump 216. Thus, the casinghead gas may be suctioned into a produced fluid intake of jet pump 216, compressed, and entrained with the produced fluids pumped into a power fluid intake jet pump 216 from the submersible pump of artificial lift subassembly 214 in a manner similar to that described above with regard to system 100.

As noted above, the present production system may be a packerless (i.e., open annulus) completion. It may be beneficial, however, to use packers in a well, and the present production system may be used with such devices.

Figure 18:
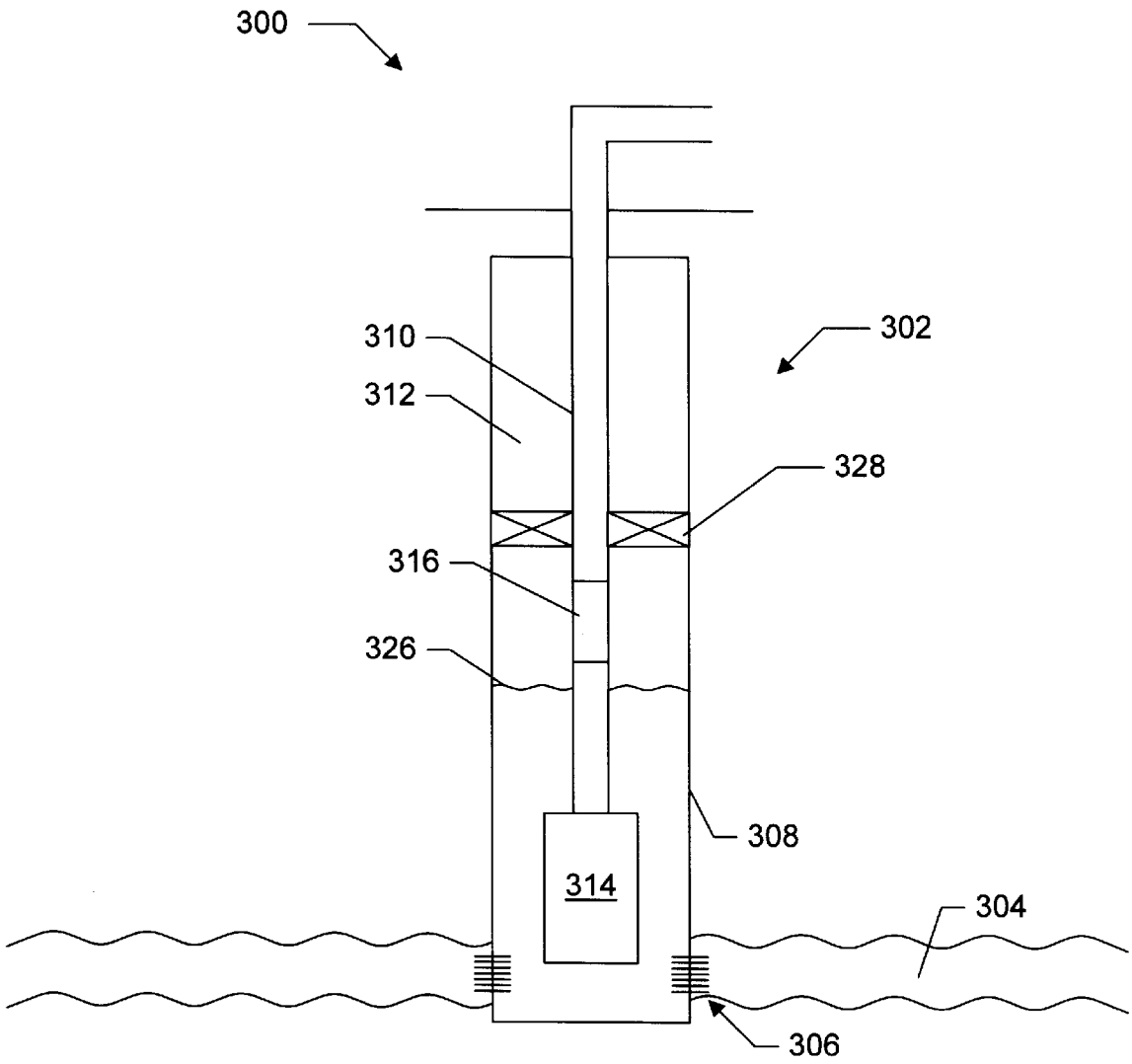
FIG. 18 is a schematic diagram of a production system for producing fluids from a well in accordance with another embodiment.

FIG. 18 depicts a schematic view of a production system 300 in accordance with another embodiment. Production system 300 may include a well 302 extending to an underground reservoir 304. Perforations 306 may be present in the reservoir to aid in production of the well. A casing string 308 may extend to or above reservoir depth. Casing string 308 may include multiple casing strings of progressively smaller diameters. A tubing string 310 may be arranged within the casing string. An annulus 312 may be defined between casing string 308 and tubing string 310. Tubing string 310 may extend, in an embodiment, to a depth above the bottom depth of casing string 308. An artificial lift sub-assembly 314 may also be installed within the well, and in an embodiment may be installed below a fluid level 326 within the well. The artificial lift sub-assembly may include a gas separator upstream of the submersible pump as described above. A jet pump 316 may be located downstream of artificial lift sub-assembly 314. Components shown in FIG. 18 having similar reference numbers as components shown in FIG. 3 may constructed similarly and may perform in a similar manner as their counterpart components from FIG. 3 (e.g., jet pump 316 may perform similarly to jet pump 116, and tubing 310 may be composed of the same materials as tubing 110). In addition, system 300 may include components of FIG. 3 that are not shown in FIG. 18, such as a well head. Appropriate modifications may be made, however, to the design and/or function of each element in accordance with the particular conditions of each embodiment. Production system 300 may be implemented in offshore or onshore wells.

As shown in FIG. 18, production system 300 may also include isolation packer 328. Isolation packer 328 may be used to isolate an upper part of annulus 312 from a lower part for a variety of purposes, including broken casing or perforations that are to be isolated from the production zone. Isolation packer 328 may substantially prevent free gas flow up annulus 312 when well 302 is shut in, forcing the gas to instead accumulate below packer 328.

System 300 may be operated in a manner similar to that described for system 100. During operation, free gas (e.g., separated gas) within annulus 312 and below isolation packer 328 may serve as a produced gas for jet pump 316. Thus, the separated gas may be suctioned into a produced fluid intake of jet pump 316, compressed, and entrained with the produced fluids pumped into a power fluid intake of jet pump 316 from the submersible pump of artificial lift sub-assembly 314 as described above with regard to system 100. Such a design may result in reduced pressure in the separated gas within annulus 312, leading to a lower flowing bottomhole pressure. The pressure in the annulus below the packer may be maintained below bubble point pressure, which may allow producing the well at higher rates.

As noted above, the present production system may combine a production system including a jet pump and a submersible pump with gas lift injection techniques. Gas lift processes may incorporate several gas lift valves on the tubing string into which gas may be injected. These valves may be subdivided into unloading valves (of which there may be several) and an operating valve. Each valve may be set to open at a pre-determined differential pressure (e.g., pressure difference between the annulus and the tubing). More specifically, each valve may be a spring-loaded system, with the valve set to open at a predetermined differential pressure across the valve.

After a well incorporating gas lift valves has been shut in for a significant period of time, the fluid level within the well may rise above at least one, and possibly all, of the gas lift valves. The unloading valves may aid in lowering the fluid level below the bottommost operating gas lift valve, to allow for more efficient operation. The unloading process may begin by injecting gas into the annulus from a gas injection system outside of the well, pressurizing the annulus and increasing the differential pressure across the valves. As a result of this change in differential pressure between the annulus and production tubing, the valves may selectively open (depending on their respective settings), permitting gas from the annulus to enter the liquid column within the tubing and reducing the pressure at depth due to the weight of the tubing fluid column.

Preferably, the fluid level is pushed below each unloading valve sequentially. Each unloading valve may be designed to close when the next valve below it is opened. Finally, the fluid level is forced below the level of the operating valve and all the unloading valves are closed. From that point on, injected gas preferably enters the tubing through the operating gas lift valve.

Figure 19:
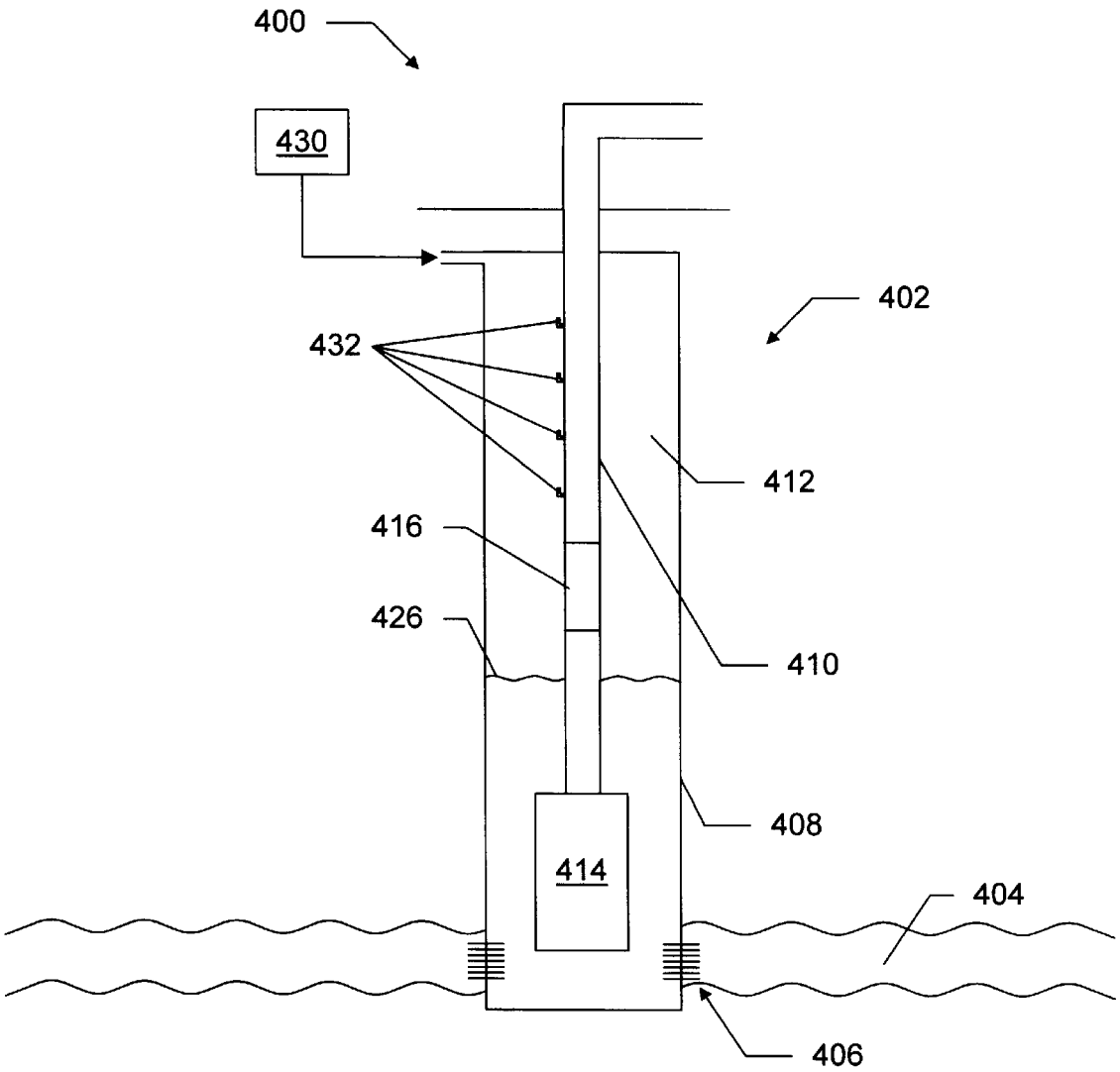
FIG. 19 is a schematic diagram of a production system for producing fluids from a well in accordance with another embodiment.

FIG. 19 depicts a schematic view of a production system 400 in accordance with another embodiment in which gas lift injection techniques are incorporated into a production system including a jet pump and a submersible pump. Production system 400 may include a well 402 extending to an underground reservoir 404. Perforations 406 may be present in the reservoir to aid in production of the well. A casing string 408 may extend to or above reservoir depth. Casing string 408 may include multiple casing strings of progressively smaller diameters. A tubing string 410 may be arranged within the casing string. An annulus 412 may be defined between casing string 408 and tubing string 410. Tubing string 410 may extend, in an embodiment, to a depth above the bottom depth of casing string 408. An artificial lift sub-assembly 414 may also be installed within the well, and in an embodiment may be installed below a fluid level 426 within the well. The artificial lift sub-assembly may include a gas separator upstream of the submersible pump as described above. A jet pump 416 may be located downstream of artificial lift sub-assembly 414. Components shown in FIG. 19 having similar reference numbers as components shown in FIG. 3 may constructed similarly and may perform in a similar manner as their counterpart components from FIG. 3 (e.g., jet pump 416 may perform similarly to jet pump 116, and tubing 410 may be composed of the same materials as tubing 110). In addition, system 400 may include components of FIG. 3 that are not shown in FIG. 19, such as a well head. Appropriate modifications may be made, however, to the design and/or function of each element in accordance with the particular conditions of each embodiment. Production system 400 may be implemented in offshore or onshore wells.

As shown in FIG. 19, production system 400 may also include gas lift injection system 430. Gas injection system 430 may be configured to inject gas lift gases into well 402, and preferably into annulus 412. In an embodiment, jet pump 416 may be substituted for the operating gas lift valve of a conventional gas lift injection assembly. Thus, gas injected into annulus 412 from gas lift injection system 430 may enter tubing string 410 within well 402 through the produced fluid intake of jet pump 416 to supply gas lift forces to fluids within tubing 410. Gas injection system 430 may be arranged outside of the well above ground level (e.g., above the sea floor for offshore wells, above surface level for onshore wells).

Production system 400 may also include at least one, and preferably several, gas lift valves 432. Gas lift valves 432 may further be arranged along tubing string 410 uphole of jet pump 416. The gas lift valves may each be configured to selectively permit gas injected into annulus 412 to pass therethrough and, in an embodiment, to pass through the gas lift valves into tubing string 410. That is, gas lift valves 432 may be configured to open and close to allow and prevent, respectively, fluids from passing therethrough under certain pre-determined conditions.

In a further embodiment, gas lift valves 432 may be unloading gas lift valves. Thus, the gas lift valves may be used to unload well 402 to allow gas to be injected into the produced fluid intake of jet pump 416. In such an unloading process, fluid level 426 may be above at least one, and possibly all, of gas lift valves 432. Gas may be injected into annulus 412 to depress fluid level 426. As fluid level 426 within well 402 drops below each gas lift valve 432, the gas lift valves may each selectively permit gas injected into annulus 412 to enter tubing 410, further aiding in the depression of the well fluid level. Gas lift valves 432 may open once a pre-determined differential pressure level across each valve is reached, allowing injected gas to enter tubing 410. After injected gas as been selectively permitted to pass through each of gas lift valves 432, the fluid level within well 402 may be lowered below jet pump 416 (as shown in FIG. 19). Gas lift valves 432 may remain closed when fluid level 426 is below jet pump 416 (e.g., during normal operation of the production system), allowing substantially all of the injected gas to enter tubing string 410 through jet pump 416. Gas lift valves 432, however, are not required to be closed during normal operation of system 400; e.g., one or more of the valves may be set to be open during such time. Once pumped to the surface, the injected gas may be separated out by a gas separator above the surface and re-injected into the well.

Because, among other things, jet pump 416 may compress injected gas, system 400 may be significantly more efficient than conventional gas lift systems. As noted above, system 400 may allow for the use of lower gas injection pressures than conventional gas lift systems to achieve similar results (possibly as low 30–40% of the injection pressure needed if a conventional operating gas lift valve were used in place of the jet pump). Alternately, gas injection into a jet pump as presented herein may allow for injection of gas at higher rates.

System 400 may be operated in a manner similar to that described for system 100. During normal operation, separated gas and injected gas within annulus 412 may serve as a produced gas for jet pump 416. Thus, such gases may be suctioned into a produced fluid intake of jet pump 416, compressed, and entrained with the produced fluids pumped into a power fluid intake of jet pump 416 from the submersible pump of artificial lift subassembly 414 in a manner similar to that described above with regard to system 100.

The number of unloading gas lift valves used in such a system may be greater or lesser that that shown. In addition, system 400 is not required to use additional gas lift valves at all, and may instead inject gas directly and only into jet pump 416.

Modeling

The operation of a production system (such as production system 100) was simulated using a numeric model. In such a model, the system was analyzed as three coupled subsystems: the ESP, the low GLR multiphase flow in the tubing string, and finally the flow inside the jet pump. Both the individual models used for the ESP performance and the multiphase flow inside the tubing string are available in the literature. The modeling of the multiphase flow of fluids inside the LJGP was developed based on the simultaneous solution of the mass, momentum, and energy conservation equations.

1. Electrical Submersible Pump Performance Correlation

As stated above, the first subsystem of the production system may be an ESP. While some studies have been done about the performance of centrifugal pumps handling gassy fluids, these studies have little application to the petroleum industry. To model the performance of the ESP, the correlation of Sachdeva[2,3,4] will be used. It is a correlation based on a dynamic model. The approximate correlations were developed by Sachdeva to overcome the difficulty in solving the complicated dynamic model and they correlate the pressure increase per stage, pump inlet pressure, pump inlet void fraction and the liquid flow rate. The correlation results were compared with experimental data obtained by Lea and Bearden[5] and showed reasonable agreement.

$$\Delta P = K(P_{in})^{E1}(\alpha_{in})^{E2}(Q_L)^{E3}$$

Here $\Delta P$ is in psi per stage, $P_{in}$ is the pump inlet pressure in psig, $\alpha_{in}$ is the pump inlet void fraction (not percent), and $Q_L$ is in gallons/min. In this correlation, the factors K, E1, E2, and E3 are functions of the type of the pump. Factors were obtained for three different pumps as presented in Table 1. The void fraction is obtained from the manufacturer's published RGS efficiencies.

TABLE 1

Sachdeva's[3] Correlation Coefficients

| Pump | K | E1 | E2 | E3 |
|---|---|---|---|---|
| I-42B | 1.154562 | 0.943308 | −1.175596 | −1.300093 |
| C−72 | 0.1531026 | 0.875192 | −1.764939 | −0.918702 |
| K−70 | 0.0936583 | 0.622180 | −1.350338 | −0.317039 |

2. Multiphase Flow in the Pipes

Figure 4:
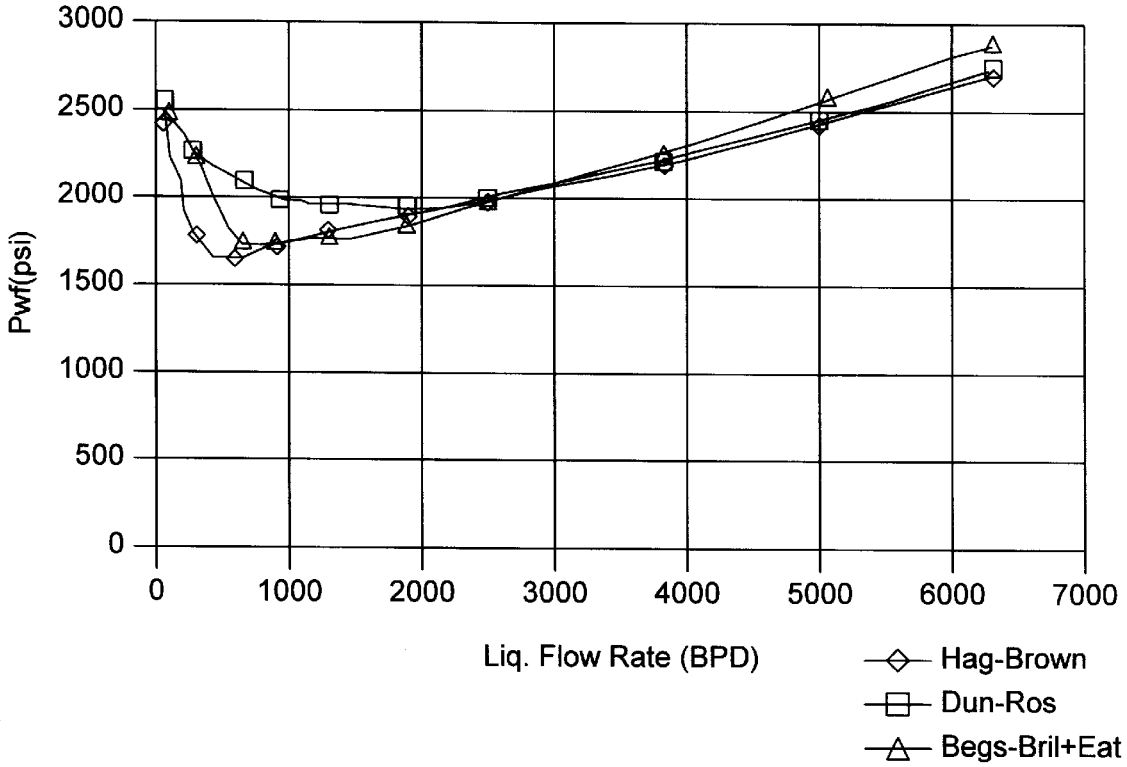
FIG. 4 is a graph of the multiphase flow correlation results for multiphase flow inside a tubing string.

In order to calculate the pressure gradient inside the tubing, i.e., the curve of tubing pressure versus depth, the multiphase flow simulator Simult[7] developed in-house at Petrobras was used. The first step was to choose a vertical multiphase flow correlation to use. The result for the case is presented in FIG. 4 and shows a good agreement between the correlation of Beggs-Brill[8] and the correlation of Hagedorn-Brown[9], in the flow rate range to be investigated. The Hagedorn-Brown correlation was chosen because it is one of the most-used in normal petroleum wells. With the selected vertical multiphase flow correlation chosen, the required tubing intake pressure for each flow rate could be calculated.

3. Jet Pump Model

The jet pump model used herein has been described above in part. The theoretical development that follows adopts some reasonable simplification. Application of continuity and momentum relations (including frictional forces) produces the following expressions:

Nozzle Equation $$\overline{P}_I - P_o = Z(1+K_{nz}) \tag{1}$$

Mixing Throat Momentum Equation $$(P_t - P_o) = Z\left[2b - (2+K_{th})(1+\gamma\phi_o)b^2(1+\phi_t) + 2\gamma\frac{\phi_o^2 b^2}{1-b}\right] \tag{2}$$

Diffuser Flow Equations $$P_d - P_t = Z(1+\gamma\phi_o)\left[b^2(1+\phi_t)^2 - a^2b^2(1+\phi_d)^2 - K_{dt}b^2(1+\phi_t)\right] - P_o\phi_o\ln\frac{P_d}{P_t} \tag{3}$$

The solution of equation (3) requires point-to-point input of $P_t(\phi_o)$ values obtained from the throat equation (2). With $P_t(\phi_o)$, $\phi_t = P_o\phi_o/P_t$. could be calculated. Substituting these values into equation (3) and rearranging results in $$P_d + Z(1+\gamma\phi_o)a^2b^2\left(1+\frac{P_o\phi_o}{P_d}\right)^2 + P_o\phi_o\ln\frac{P_d}{P_i} = P_i + Z(1+\gamma\phi_o)\left[b^2(1+\phi_t)^2 - K_{dt}b^2(1+\phi_t)\right] \tag{4}$$

$$F(P_d) = P_d + C_3\left(1+\frac{P_o\phi_o}{P_d}\right)^2 + P_o\phi_o\ln\left(\frac{P_d}{P_i}\right) - C_4 \tag{5}$$

where $$C_3 = Z(1+\gamma\phi_o)^2b^2 \tag{6}$$

$$C_4 = P_t + Z(1+\gamma\phi_o)[b^2(1+\phi_t)^2 - K_{dt}b^2(1+\phi_t)] \tag{7}$$

To solve this non-linear equation, the Newton-Raphson Method is used with $$\frac{dF(P_d)}{dP_d} = \frac{(P_d + P_o\phi_o)(P_d^2 - 2C_3P_o\phi_o)}{P_d^3} \quad (8)$$

The energy input is $e_{in}=Q_1(P_iP_d)$. The overall pressure drop may be obtained combining the three pressure-difference equations: equation (1) minus equation (2) minus equation (3). The useful output work is ideally the isothermal compression of the gas from $P_s$ to $P_d$, which is $$W_{out} = Q_{2s}RT_s\ln\left(\frac{P_d}{P_t}\right) \quad (9)$$

The pump efficiency is defined as $\eta_{jp}=W_{out}/e_{in}$ so that $$\eta_{jp} = \frac{P_s\phi_s}{P_t - P_d}\ln\left(\frac{P_d}{P_t}\right) \quad (10)$$

Figure 6:
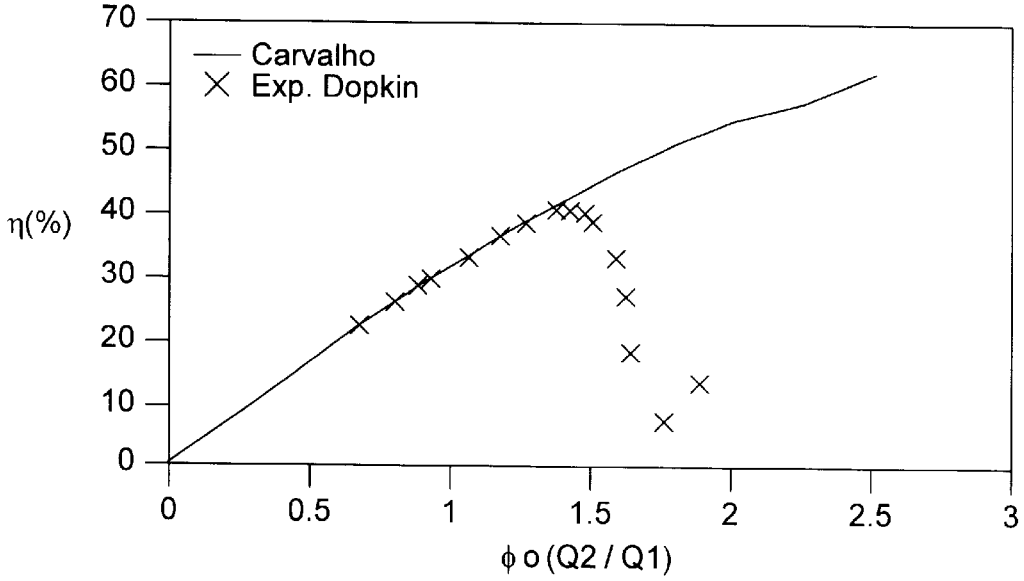
FIG. 6 is a graph comparing theoretical and experimental results for a liquid jet gas pump.

The model for the sub-system LJGP was used and the results obtained showed good agreement with literature experimental data[10,11,13]. FIG. 6 shows the behavior of the efficiency $\eta$ as a function of the volumetric flow ratio $\phi_o$. As $\phi_o$ increases, the efficiency and the mixing zone length also increase. There is, however, a point of maximum efficiency. After this point, the measured efficiency drops sharply and the comparison between the experimental and theoretical results is very poor. It was observed that, whenever the mixing zone is in the throat region, the comparison of the experimental points to the theoretical ones is excellent. It is attributed the fact that the experimental results do not agree with the theory, after a certain $\phi_o$, to the hypotheses used in the model which is the mixture between the phases is completed inside the throat region where the diameter is constant and the area known. Hence, the increase in the volumetric flow ratio causes an increase in the mixing length such that, when it is greater than the throat length, the model does not represent the process anymore.

Figure 7:
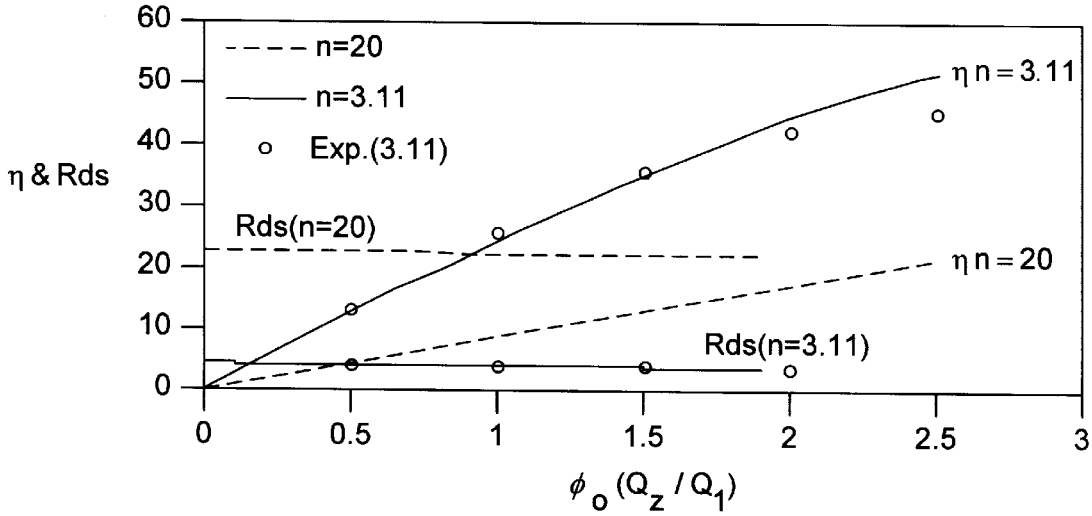
FIG. 7 is a graph of compression ratio versus volumetric ratio for a liquid jet gas pump.
Figure 8:
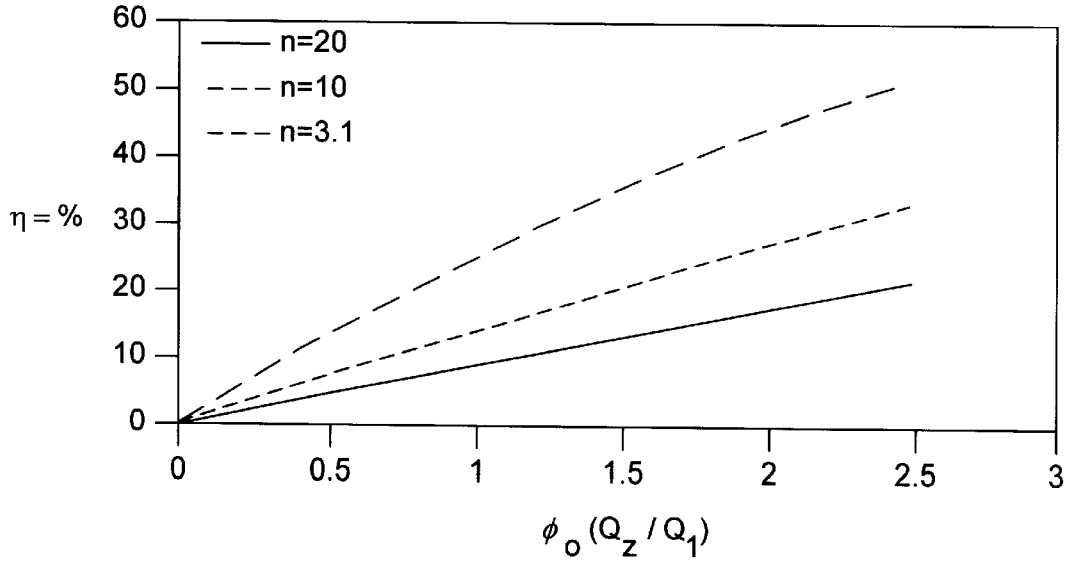
FIG. 8 is a graph of efficiency versus jet pump number for a liquid jet gas pump.

FIG. 7 shows that as the volumetric flow ratio increases, the pump efficiency increases and the compression ratio $R_{ds}$ decreases for a generic case. A jet pump number may be defined for the geometric plus operational conditions of the LJGP as $n=2Zb^2c/P_o$. In FIGS. 7 and 8, it may be observed that as the jet pump number n increases, the pump efficiency decreases and the $R_{ds}$ increases. This characteristic will permit the LJGP pump designer to have higher compression ratios by increasing the jet pump number at the cost of a lower efficiency.

Some difference between the obtained results and simulated data available in the literature[12], observed for high gas-liquid volumetric flow ratio, is possibly explained by the fact that the $\gamma\phi_o$ and the loss coefficients K's are not neglected. This difference may be observed in FIG. 7, where some results from the Cunnigham[12] work were plotted along with the simulated results.

EXAMPLES

1. Application of the System

The system simulator was used in a case study for an offshore well in the Campos Basin, Brazil. In order to investigate feasibility of this new design, a simple application to a typical well was calculated. The data from a typical medium well are presented below.

| | | |
|---|---|---|
| Liquid Flow Rate | 169 | $m^3/d$ |
| GLR (Solution Gas) | 50 | $m^3/m^3$ |
| Free Gas at Pump Intake | 10% | (16.9 $m^3$) |
| Degrees API | 26 | |
| BS&W | 20% | |
| Gas Density | 0.75 | (air = 1.0) |
| Water Density | 1.05 | |
| Reservoir pressure | 189.9 | $kgf/cm^2$ |
| Reservoir Depth | 2000 | m |
| Productivity Index -- Linear | 1.41 | $m^3/d/kgf/cm^2$ |
| Pump Intake Depth | 1970 | m |
| Tubing Internal Diameter | 0.076 | m |
| Wellhead Pressure | 7.0 | $kgf/cm^2$ |
| Casinghead Pressure | 5.0 | $kgf/cm^2$ |

Figure 9:
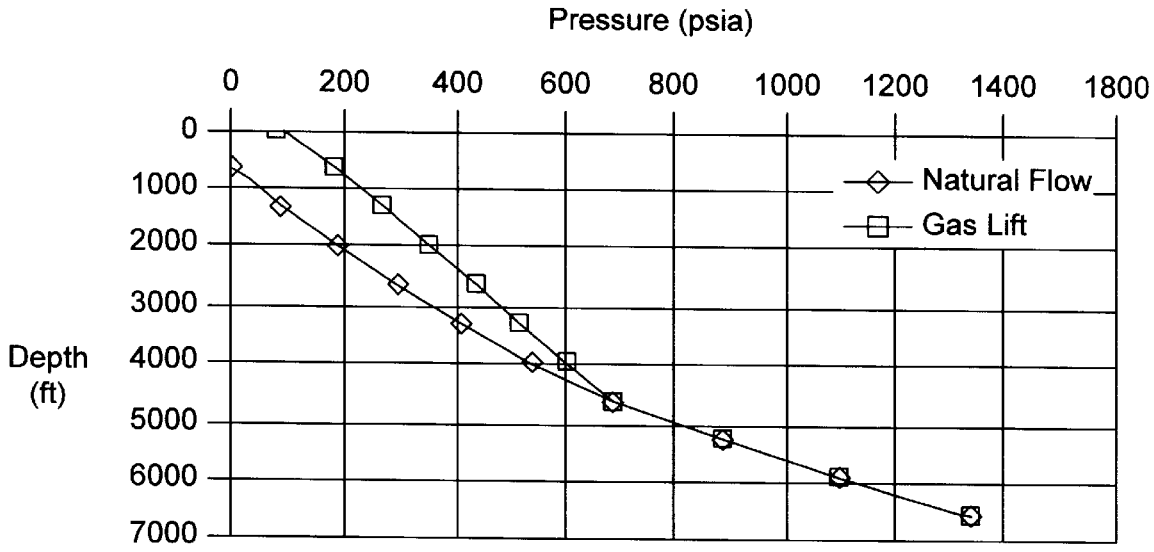
FIG. 9 is a graph of tubing pressure with and without gas lift in the Marlin well.

The results show that the utilization of the system to this typical gassy well is feasible. It may be seen in FIG. 8 that this well is not capable of producing naturally; e.g., with the reservoir pressure there is little or no pressure at the surface. Therefore, it is necessary to install an AL method to supply energy to the fluids to reach the surface with the desired flow rate. In the case presented in FIG. 9, the injection of lift gas at 4500 ft results in a wellhead flowing pressure of approximately 100 psi. Since the GL is not recommended for long-distance horizontal flowlines, the ESP is an AL method to be considered. Without the installation of the ESJP, the ESP method is generally not applicable to the well due to the high free-gas content at the pump intake.

2. The Prototype Test

The theoretical result provided motivation to continue the development of the ESJP. A prototype test was conducted in the production laboratory at The University of Texas at Austin. In this test, an ESP set (see equipment description in Table 2) obtained from Reda Pump Incorporated was installed with a Jet Pump obtained from Trico Industries. While the ESP equipment was a conventional one, the jet pump was a modified liquid-liquid jet pump. The modification was made in the liquid-liquid jet pump to allow the power fluid to enter from the lower part of the device while the produced fluid was supplied from the annulus. The throat length, as well as the nozzle, throat, and diffuser diameters were the same used for the liquid-liquid application.

TABLE 2

Electrical Submersible Pump Equipment Description

| | |
|---|---|
| Pump | |
| Series | 456 |
| Model | REDA DN 1750 |
| Number of Stages | 32 |
| Motor | |
| Series | 456 |
| Power | 18.85 HP |
| Volts | 456 V |
| Amperes | 9 A |
| Electrical Cable | |
| Type | Round REDALERT |
| Size | #1 AWG |

Figure 10:
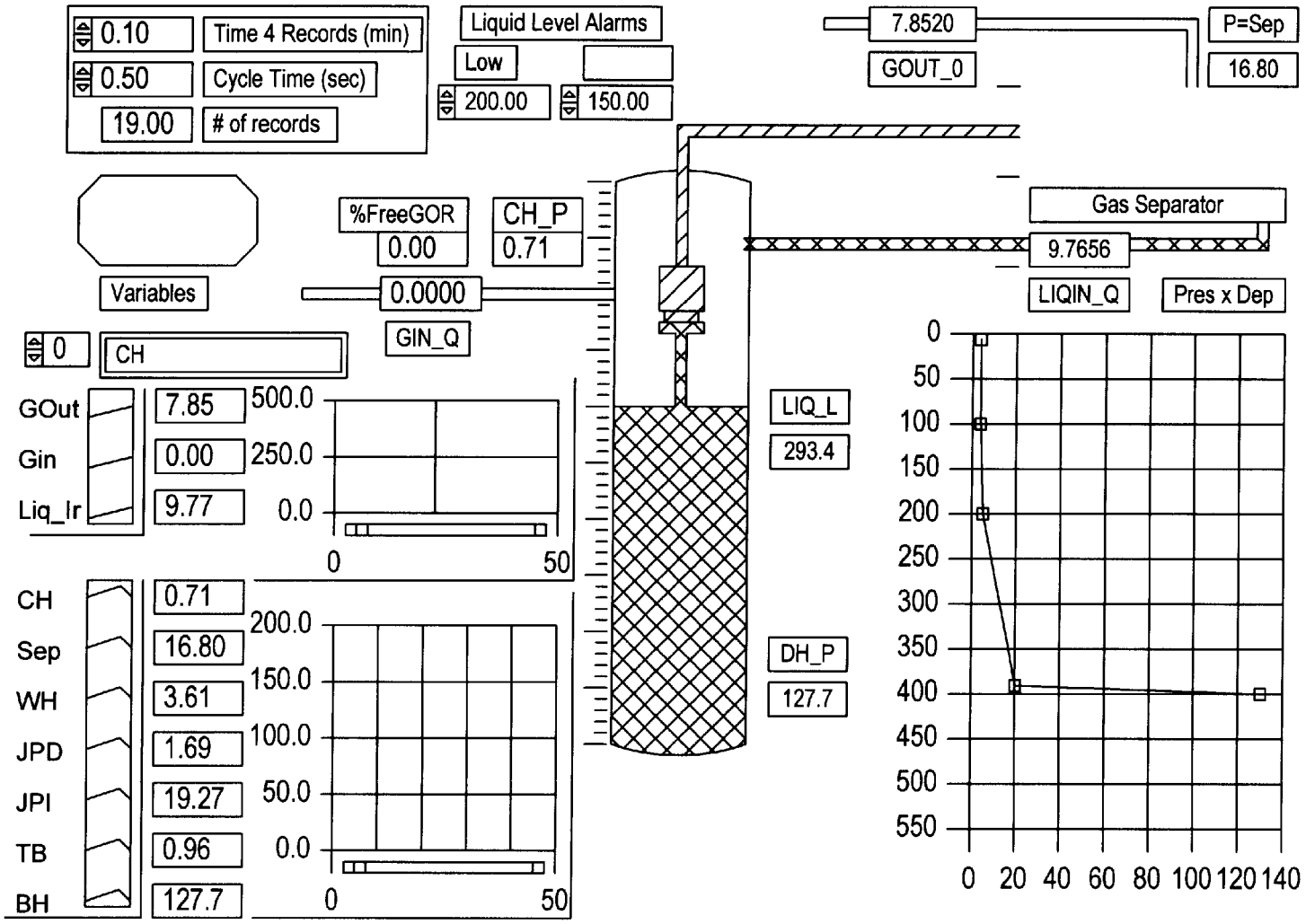
FIG. 10 is an illustration of the front panel of a control/data acquisition system for the prototype test.

The completion of the 550-ft deep well was made in a way that the ESP set was installed at the depth of 512 ft and the jet pump was installed at the depth of 129 ft from the surface. A 2⅞ in. fiberglass tubing string was used with a conventional Christmas tree using a Hercules ESP wellhead adapter. The well was equipped with some pressure sensors, installed along the tubing string and in the annulus at different depths, in order to monitor the pressure profile. A control and data acquisition system was developed that records in a specific file all operational well information during the test run. The system was developed under Labview[14] and uses two data-acquisition boards installed in the lab computer. FIG. 10 shows the front panel of the control/data acquisition system. During the test, all measured variables may be read on line. In addition, the last 1,000 values in the graphs may be seen just by moving the scroll bar backwards. Another feature of the control/data acquisition system is the ESP protection; under such conditions, running the ESP without liquid flow bums out the motor after a very short time. A safety routine was implemented to prevent the possibility of running the ESP set without liquid.

Figure 11:
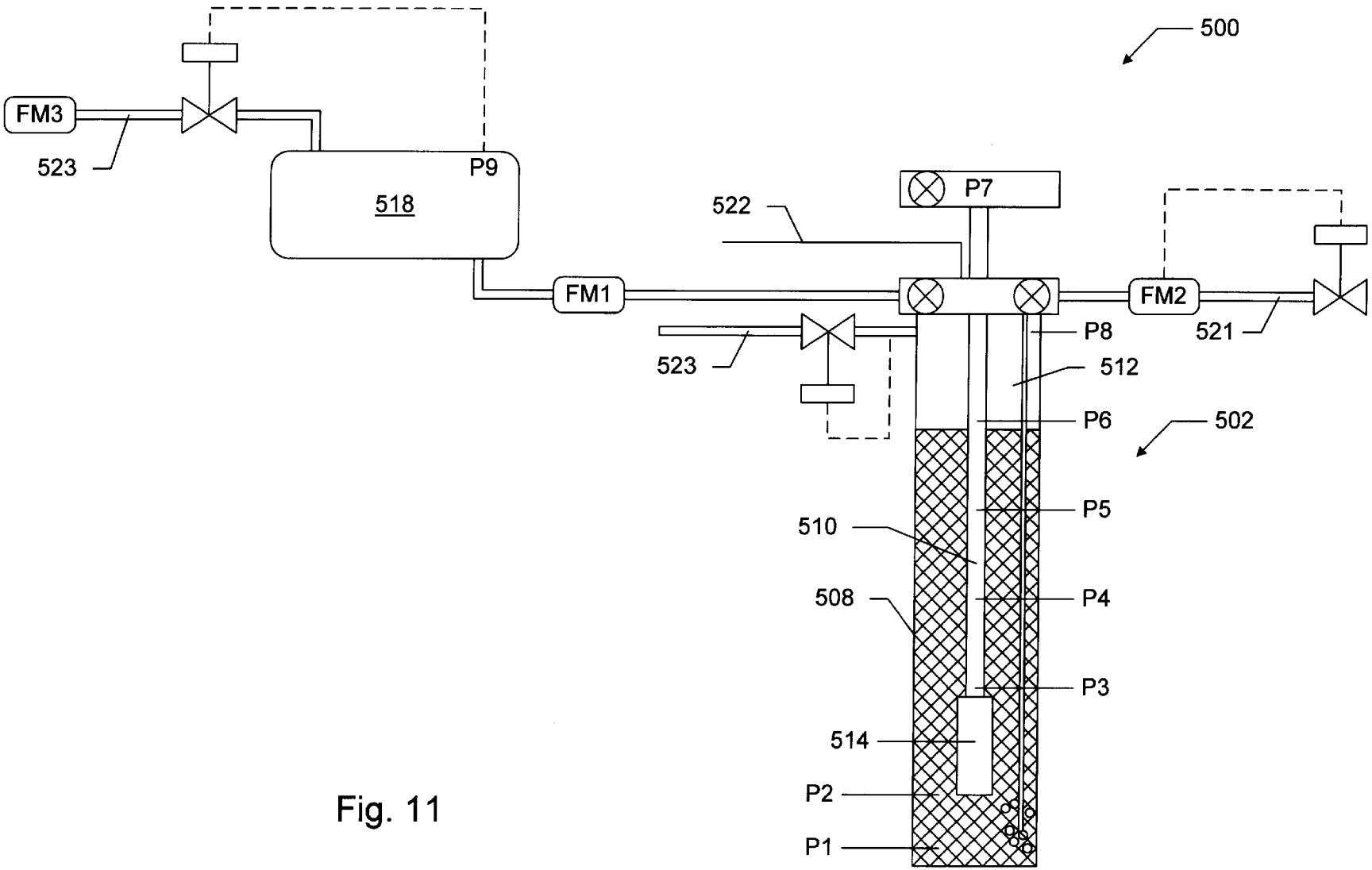
FIG. 11 is a schematic diagram of a test loop used in the prototype test.
Figure 12:
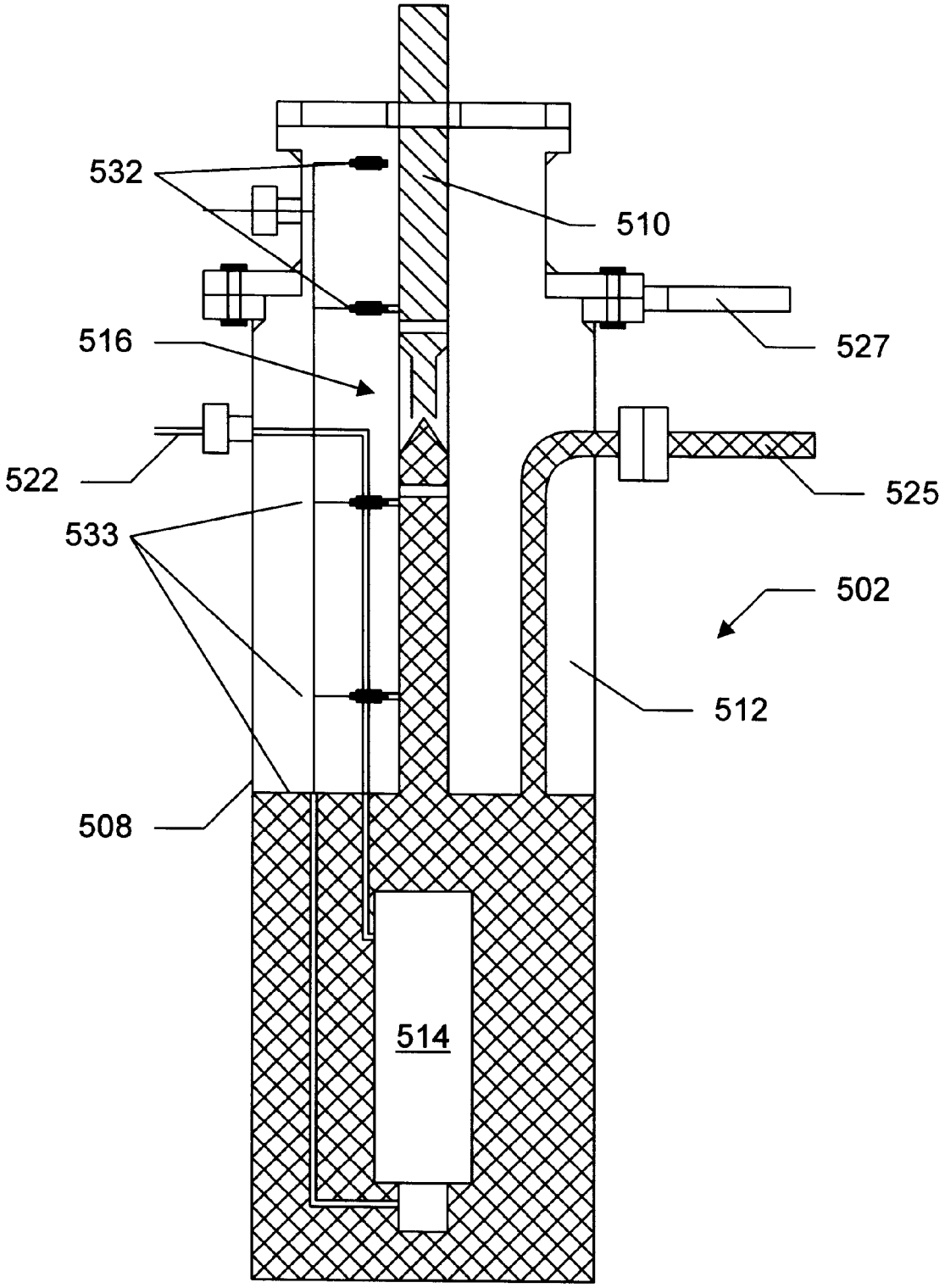
FIG. 12 is a diagram of the test well tubing string configuration.

FIG. 11 shows a schematic diagram of test loop 500 and FIG. 12 shows in detail the tubing string configuration. Test loop 500 included well 502. Several pressure sensors 533 (P1–P9 in FIG. 11) were installed at various points along test loop 500. Well 502 included tubing 510 and casing 508, with annulus 512 defined therebetween. Artificial lift sub-assembly 514 included the ESP. Jet pump 516 was arranged upstream of artificial lift sub-assembly 514. Gas line 517 was provided as shown. Electrical cable 522 was provided to deliver power to various elements of the test loop. Vent lines 520 and 523 were provided as shown. Air line 527 and water line 525 were provided as shown. Two pressure sensors were installed in the annulus: one at the ESP depth for the variable bottomhole pressure, and another at the casinghead for the variable casinghead pressure. Inside the tubing, four pressure sensors were installed. The first one was installed halfway between the ESP discharge and the JP intake for the variable tubing pressure. At the JP depth, two pressure sensors were installed, one upstream and another downstream of the jet pump device. The variable names are Jet Pump Intake and Jet Pump Discharge pressures. The system is a closed loop for the liquid and an open loop for the gas; e.g., the liquid is pumped back into well 502 after being separated in the three-phase separator 518 and the gas is vented to the atmosphere. Two alternative gas compressors compress the supplied air to the system with a total capacity up to 1 million SCF/D at 300 psig.

Figure 13:
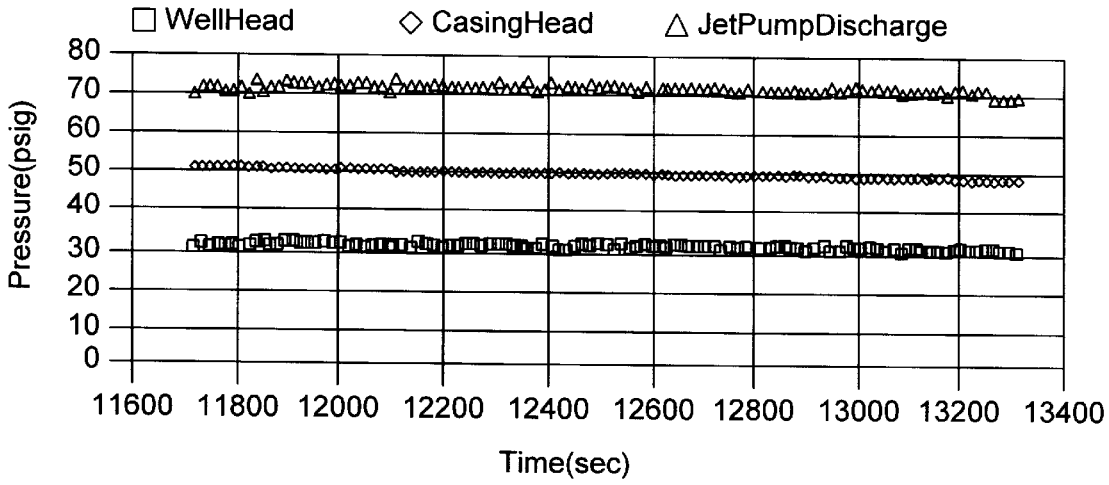
FIG. 13 is a graph of pressure behavior results obtained during testing.
Figure 14:
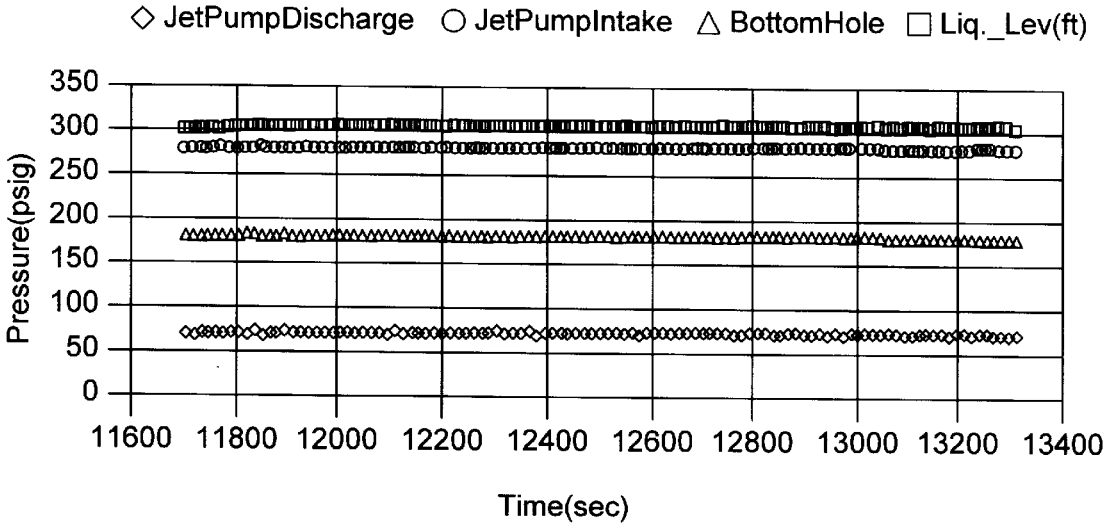
FIG. 14 is a graph of pressure behavior results obtained during testing.
Figure 15:
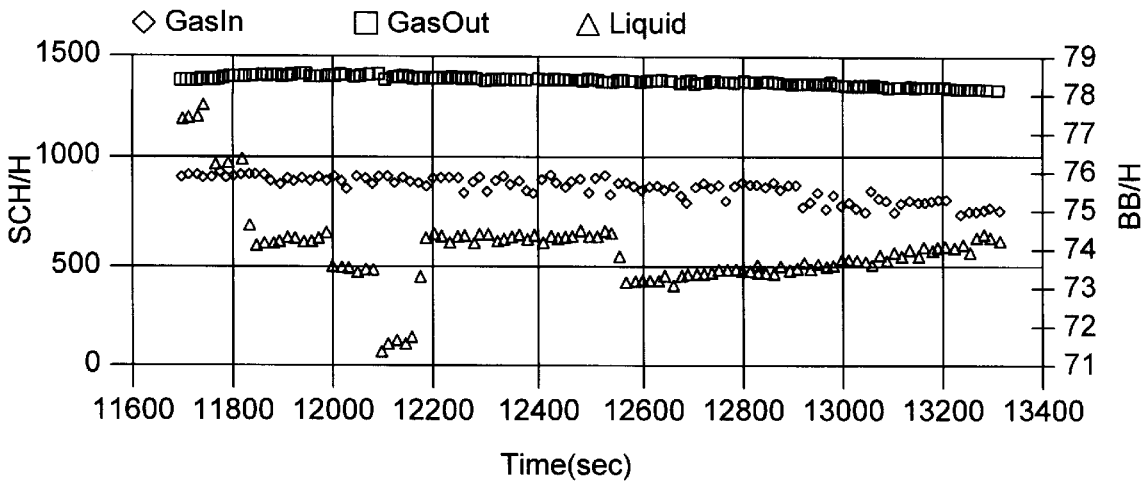
FIG. 15 is a graph of flow rate behavior results obtained during testing.
Figure 16:
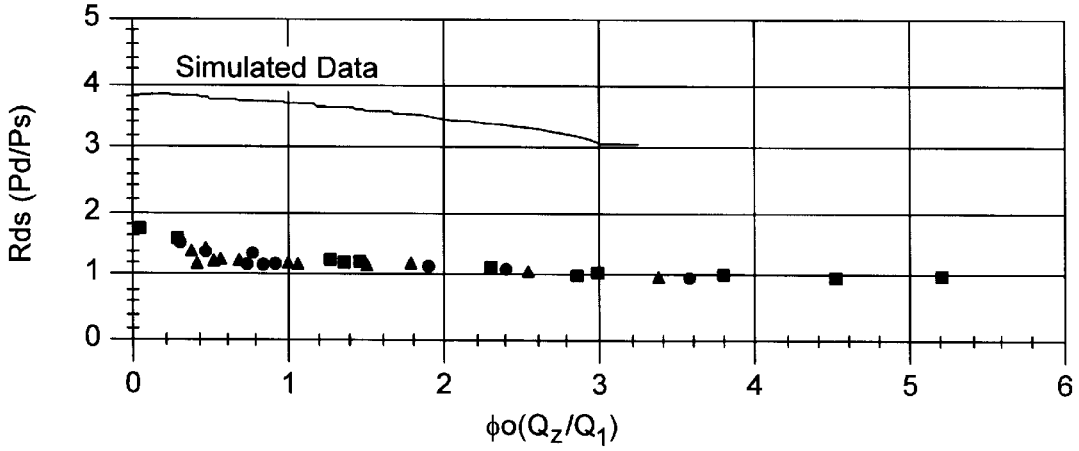
FIG. 16 is a graph of the compression ratio versus the volumetric flow ratio for the test data.

Within the equipment limitation, a series of tests were performed and 38 different operational conditions were investigated. One set of results obtained in the test is presented in FIGS. 13, 14, and 15. FIGS. 13 and 14 show us the pressure behavior and FIG. 15 presents the gas and liquid flow rated. FIG. 16 presents a summary of the tests performed in terms of compression ratio, e.g., the ratio of jet pump discharge pressure over casing pressure at the jet pump depth, versus the volumetric flow ratio $\phi_o$ (Q2/Q1). The results present very good repeatability and reproducibility.

The behavior observed in the curve presented in FIG. 16 is somewhat different from what was expected from the theoretical model. Although the overall behavior is as predicted, i.e., as the volumetric flow ratio increases the compression ratio decreases, the experimental results present a sharp decrease for the lower volumetric flow ratios while the theoretical model predicts a flat behavior all along the curve. One possible explanation for this anomaly is the fact that a liquid-liquid jet pump is used to perform gas compression. The geometry of the device, possibly, is not appropriate and results in a poor efficiency.

It should be understood that an annulus as described herein is not required to be defined between a tubing string and a casing string. Rather, an annulus may also be defined between, among other things, a tubing string and a wellbore. Furthermore, while "draw in" may be considered to relate to the suctioning of a substance, "receive" may be construed to cover the reception of the substance with or without suction.

It will be appreciated by those skilled in the art having the benefit of this disclosure that this invention is believed to provide a production system for producing fluids from a well incorporating a jet pump and a submersible pump. Further modifications and alternative embodiments of various aspects of the invention will be apparent to those skilled in the art in view of this description. For example, the present system may also be used to produce wells drilled at least partially horizontally. Further, gas injected into gas lift valves during an unloading process may pass through each of the gas lift valves in sequence, all at once, or in combinations thereof.

Accordingly, this description is to be construed as illustrative only and is for teaching those skilled in the art the general manner of carrying out the invention, and is not be regarded in a restrictive sense. It is to be understood that the forms of the invention shown and described herein are to be taken as presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

NOMENCLATURE

The following nomenclature is used herein:

$A_n$=Nozzle Area
$A_t$=Throat
$A_{2o}$=Gas annulus entrance area=$A_tA_n$.
b=Nozzle/Throat area ratio=$A_n/A_t$
$C_i$=Constants for $F(P_d)$
c=Area ratio=$A_{2o}/A_n$=(1−b)/b
$g_c$=Gravitational constant
$K_{nz}$=Nozzle friction loss coefficient
$K_{en}$=Throat entry friction loss coefficient
n=Jet pump number $2Zb^2c/P_o$
Pi=Nozzle inlet pressure
$P_o$=Nozzle outlet pressure
$Q_{1o}$=Liquid volumetric flow rate
$Q_{2o}$=Gas volumetric flow rate
R=Universal gas constant
$R_{to}$=Compression Ratio $P_t/P_o$
$V_l$=Liquid velocity
Z=Jet velocity head=$\rho_i V_{io}^2/2g_c$
$\gamma$=Density ratio $\rho_{2o}/\rho_l$
$\eta$=Efficiency
$\phi_o$=Volumetric flow ratio at throat entry $Q_{2o}/Q_1$
$\phi_t$=Volumetric flow ratio at throat exit $Q_{2t}/Q_1$
$\rho_l$=Liquid density

REFERENCES

1. Lea J. F. and Bearden, J. L.: "Effect of Gaseous Fluids on Submersible Pump Performance", paper SPE 9218 presented at the 1980 SPE Annual Technical Conference and Exhibition, Dallas, Tex., September. 21–24.
2. Sachdeva, R., Doty, D. R., and Schmidt, Z.: "Performance of Electrical Submersible Pumps in Gassy Wells," paper SPE 22767 presented at the 66th SPE Annual Technical Conference and Exhibition, Dallas, Tex., Oct. 6–9, 1991.
3. Sachdeva, R.: "Two Phase Flow through Electrical Submersible Pumps." Ph.D. dissertation, The University of Tulsa, Tulsa, Okla., 1988.

4. Sachdeva, R.: "Understanding Multiphase Dynamics in ESP s For Better Multiphase Pump Design," SPE Gulf Coast ESP Workshop, Apr. 29 1992.
5. Turpin, J. L., Lea, J. F., and Bearden, I L.: "Gas-Liquid Flow Through Centrifiagal Pumps—Correlation of Data7, Proc., 33rd Annual Southwestern Petroleum Short Course, Lubbock, Tex., (1986).
6. Welte, K. A.: "Dealing with Excessive Free Gas Electrical Submersible Pump Operations," paper presented at the 1990 SPE Gulf Coast Section ESP Workshop, Houston, Tex.
7. Simulador de Fluxo Multifásico em Tubulações-Simult, Comunicação Interna Petrobras.
8. Beggs, H. D., and Brill, J. P.: "A Study of Two-Phase Flow in Inclined Pipes," Journal of Petroleum Technology, May 1973, pp. 607–617.
9. Hagedorn, A. R., and Brown, K. E.: "Experimental Study of Pressure Gradients Occurring During Continuous Two-Phase Flow in Small-Diameter Vertical Conduits," Journal of Petroleum Technology, April 1965, p. 475–484.
10. Betzler, R. L.: "The Liquid-Gas Jet Pump Analysis and Experimental Results," MS thesis, The Pennsylvania State University, 1969.
11. Higgins, H. W.: "Water Jet Air Pump Theory and Performance," MS thesis, The Pennsylvania State University, 1964.
12. Cunningham, R. G., and Dopkin, R. J.: "Gas Compression With the Liquid Jet Pump," Journal Of Fluids Engineering Trans ASME, Series 1, Vol. 94, No. 3, September 1974, pp. 203–215.
13. Dopkin, R. J.: "The Liquid-Jet Gas Pump: A Study of Jet Breakup and Required Throat Length," MS thesis, The Pennsylvania State University, August 1973.
14. LabView V 4.5—Control and Data Acquisition Software from National Instruments, Austin, Tex.

The disclosures of all of the above references are incorporated herein by reference.

What is claimed is:

1. A production system for producing fluids from a well, comprising:

a submersible pump arranged within the well; and a jet pump arranged within the well downstream of the submersible pump, wherein the jet pump comprises a power fluid intake configured to receive a power fluid during use and a produced fluid intake configured to receive a produced fluid during use, wherein the power fluid intake is in fluid communication with the submersible pump during use, and wherein the produced fluid intake is in fluid communication with separated gas within an annulus of the well during use, and wherein the submersible pump is configured to draw in a separated fluid within the well and to pump the separated fluid downstream to the jet pump.

2. The system of claim 1, wherein the separated fluid comprises liquid hydrocarbons.

3. The system of claim 2, wherein the separated fluid comprises liquid hydrocarbons from an oil-bearing reservoir in fluid communication with the well.

4. The system of claim 1, wherein the jet pump is configured to compress the separated gas during use and to entrain the separated gas with the separated fluid to create a mixed fluid during use.

5. The system of claim 4, wherein the submersible pump is an electrical submersible pump.

6. The system of claim 4, wherein the submersible pump is arranged below a bottomhole fluid level within the well.

7. The system of claim 4, wherein the jet pump is uphole of the submersible pump.

8. The system of claim 1, wherein the well further comprises:

a casing string arranged within the well;

a tubing string arranged within the casing string; and an annulus defined between the casing string and the tubing string, wherein the produced fluid intake of the jet pump is configured to draw in separated gas from within the annulus during use.

9. The system of claim 8, wherein the separated gas comprises gases separated from fluids within the well without the use of a gas separator.

10. The system of claim 8, wherein the submersible pump is configured to pump separated fluid downstream through the tubing string during use, and wherein the power fluid intake of the jet pump is configured to receive separated fluid through the tubing string during use.

11. The system of claim 10, wherein the jet pump is configured to compress the separated gas during use and to entrain the separated gas with the separated fluid to create a mixed fluid during use, and wherein the jet pump further comprises:

a nozzle, wherein the nozzle is configured to receive a power fluid from the power fluid intake and to eject the power fluid as a liquid jet during use;

a diffuser configured to discharge a mixed fluid during use; and a throat extending between the nozzle and the diffuser.

12. The system of claim 11, wherein the nozzle is configured to receive separated fluid pumped downstream by the submersible pump during use.

13. The system of claim 12, wherein the nozzle is configured to eject the separated fluid as a liquid jet such that a low-pressure region is created that is connected to the produced fluid intake to draw in separated gas within the annulus into the jet pump during use.

14. The system of claim 13, wherein the jet pump is configured such that separated gas entering through the produced fluid intake forms a gas annulus around the liquid jet within the throat before mixing with the liquid jet during use.

15. The system of claim 11, wherein a diameter of the diffuser is greater than a diameter of the throat.

16. The system of claim 1, further comprising an isolation packer positioned within an annulus of the well.

17. The system of claim 16, wherein the isolation packer is positioned downstream of the jet pump and between a tubing string and a casing string.

18. A production system for producing fluids from a well, comprising:

a submersible pump arranged within the well; and a jet pump arranged within the well downstream of the submersible pump, wherein the jet pump comprises a power fluid intake configured to receive a power fluid during use and a produced fluid intake configured to receive a produced fluid during use, wherein the power fluid intake is in fluid communication with the submersible pump during use, and wherein the produced fluid intake is in fluid communication with separated gas within an annulus of the well during use, and wherein the production system is a packerless completion.

19. A production system for producing fluids from a well, comprising:

a submersible pump arranged within the well; and a jet pump arranged within the well downstream of the submersible pump, wherein the jet pump comprises a power fluid intake configured to receive a power fluid during use and a produced fluid intake configured to receive a produced fluid during use, wherein the power fluid intake is in fluid communication with the submersible pump during use, and wherein the produced fluid intake is in fluid communication with separated gas within an annulus of the well during use, and wherein the well is an offshore well.

20. A production system for producing fluids from a well, comprising:

a submersible pump arranged within the well; and a jet pump arranged within the well downstream of the submersible pump, wherein the jet pump comprises a power fluid intake configured to receive a power fluid during use and a produced fluid intake configured to receive a produced fluid during use, wherein the power fluid intake is in fluid communication with the submersible pump during use, and wherein the produced fluid intake is in fluid communication with separated gas within an annulus of the well during use, and wherein the well is an onshore well.

21. A production system for producing fluids from a well, comprising:

a submersible pump arranged within the well; and a jet pump arranged within the well downstream of the submersible pump, wherein the jet pump comprises a power fluid intake configured to receive a power fluid during use and a produced fluid intake configured to receive a produced fluid during use, wherein the power fluid intake is in fluid communication with the submersible pump during use, and wherein the produced fluid intake is in fluid communication with separated gas within an annulus of the well during use, and wherein the system further comprises a casinghead valve configured to selectively permit gas within the annulus to pass into a conduit outside of the well during use, wherein the casinghead valve is closed to substantially prevent gas within an annulus of the well from escaping from the well during use.

22. A production system for producing fluids from a well, comprising:

a submersible pump arranged within the well; and a jet pump arranged within the well downstream of the submersible pump, wherein the jet pump comprises a power fluid intake configured to receive a power fluid during use and a produced fluid intake configured to receive a produced fluid during use, wherein the power fluid intake is in fluid communication with the submersible pump during use, and wherein the produced fluid intake is in fluid communication with separated gas within an annulus of the well during use, and wherein the system further comprises a gas separator upstream of the submersible pump configured to separate gas from fluid to produced separated gas and separated fluid.

23. The system of claim 22, wherein the produced fluid intake of the jet pump is in fluid communication with a gas outlet of the gas separator.

24. The system of claim 23, wherein the gas separator is configured to segregate separated gas downstream within an annulus of the well during use, and wherein the jet pump is configured to draw in the separated gas through the produced fluid intake during use.

25. The system of claim 24, wherein the gas separator is a rotary gas separator.

26. The system of claim 24, wherein the gas separator is downhole of the submersible pump.

27. The system of claim 24, wherein the gas separator is arranged below a bottomhole fluid level within the well.

* * * * *